US009656280B2

(12) United States Patent
Pitsch et al.

(10) Patent No.: US 9,656,280 B2
(45) Date of Patent: May 23, 2017

(54) MULTIFUNCTION FAUCET SPRAY HEAD

(71) Applicant: AS IP Holdco, LLC, Piscataway, NJ (US)

(72) Inventors: Walter Pitsch, Washington, NJ (US); Xiao Jing Ye, Edison, NJ (US); Zhengzhen Lei, Xiamen (CN)

(73) Assignee: AS IP Holdco, LLC, Piscataway, NJ (US)

( * ) Notice: Subject to any disclaimer, the term of this patent is extended or adjusted under 35 U.S.C. 154(b) by 116 days.

(21) Appl. No.: 14/217,377

(22) Filed: Mar. 17, 2014

(65) Prior Publication Data

US 2014/0291419 A1 Oct. 2, 2014

Related U.S. Application Data

(60) Provisional application No. 61/802,286, filed on Mar. 15, 2013.

(51) Int. Cl.
*B05B 1/16* (2006.01)
*B05B 1/30* (2006.01)
(Continued)

(52) U.S. Cl.
CPC ..... *B05B 1/169* (2013.01); *B05B 1/16* (2013.01); *B05B 1/1681* (2013.01);
(Continued)

(58) Field of Classification Search
CPC B05B 1/14; B05B 1/16; B05B 1/1627; B05B 1/1681; B05B 1/169; B05B 1/30;
(Continued)

(56) References Cited

U.S. PATENT DOCUMENTS 4,303,201 A 12/1981 Elkins et al.
4,398,669 A * 8/1983 Fienhold ..... B05B 1/1654 239/447
(Continued)

FOREIGN PATENT DOCUMENTS

CN 201162860 12/2008

OTHER PUBLICATIONS

Chinese Office Action for Chinese counterpart application No. 2014800154760 and English Translation, dated Nov. 2, 2016 (6 pages).

*Primary Examiner* — Christopher Kim
(74) *Attorney, Agent, or Firm* — Morrison & Foerster LLP

(57) ABSTRACT

The disclosure includes a faucet assembly with a unique multifunction spray head. The spray head is capable of at least four spray functions, and has an outer shell; a flow body extending within the shell, a first end extending out of the shell for attachment to a faucet and a second end in fluid communication with a spray selector assembly The flow body defines a flow path from the first end of the flow body to a flow selector assembly. The spray head includes a flow selector assembly comprising: a selector valve housing body having at least four valve recesses therein; at least four flow selector valves seated within the recesses in the selector valve housing body; and a rotating selector valve ring. A sprayer seat has a faceplate thereon and a flow diversion conduit corresponding to each selector valve to provide flow paths from a selector valve to a sprayer outlet or an aerator outlet. An outer selector ring having a selector assembly seat is included for seating the flow selector assembly and engaging the rotating selector valve ring. The spray head provides aerated spray, and at least a shower spray, a jet sprayer and a misting sprayer each of which is selected by turning the outer selector ring and/or using an optional toggle selection valve for direct aerated spray if desired.

52 Claims, 28 Drawing Sheets

(51) Int. Cl.
*E03C 1/04* (2006.01)
*E03C 1/084* (2006.01)

(52) U.S. Cl.
CPC ..... *B05B 1/3026* (2013.01); *E03C 1/0404* (2013.01); *E03C 1/084* (2013.01); *E03C 2001/0415* (2013.01)

(58) Field of Classification Search
CPC ..... B05B 1/3026; E03C 1/0404; E03C 2001/0415; E03C 1/08; E03C 1/085
See application file for complete search history.

(56) References Cited

U.S. PATENT DOCUMENTS 5,577,644 A 11/1996 Heitzman
5,918,811 A 7/1999 Denham et al.
5,937,905 A 8/1999 Santos
5,961,046 A * 10/1999 Joubran ..... B05B 1/185 239/107
6,454,186 B2 9/2002 Haverstraw et al.
6,659,373 B1 12/2003 Marsh et al.
6,739,523 B2 5/2004 Haverstraw et al.
7,070,125 B2 7/2006 Williams et al.
7,111,798 B2 9/2006 Thomas et al.
7,854,401 B2 12/2010 Malek et al.
8,684,283 B2 * 4/2014 Nies ..... B05B 3/021 239/11
2001/0008256 A1 * 7/2001 Marsh ..... B05B 1/1645 239/381
2004/0164183 A1 * 8/2004 Nobili ..... B05B 1/1654 239/449
2007/0221757 A1 9/2007 Malek et al.
2010/0213282 A1 8/2010 Peel et al.
2011/0088784 A1 4/2011 Meehan et al.
2014/0291419 A1 * 10/2014 Pitsch ..... B05B 1/169 239/437

* cited by examiner

MULTIFUNCTION FAUCET SPRAY HEAD

CROSS-REFERENCE TO RELATED APPLICATION

This application claims the benefit under 35 U.S.C. §119 (e) to U.S. Provisional Patent Application No. 61/802,286, filed Mar. 15, 2013, entitled, "Multifunction Kitchen Faucet Spray Head," the disclosure of which is incorporated by reference herein in its entirety.

BACKGROUND OF THE INVENTION

Field of the Invention

The invention is in the field of kitchen faucets having varying functional spray modes.

Description of Related Art

Conventional kitchen spray heads usually offer only two functions, a shower mode and an aerator mode. These two modes are generally switched by a lever mechanism or a pull down diverter. Such a faucet can tackle most daily use. However, due to the restriction of flow rate, the flow coming out from the spray function usually becomes more gentle and soft than the aerated spray. As such, the spray typically cannot clean the dishes and sink efficiently.

Further, with the enforcement of some water saving code requirements, the flow rate of kitchen faucets is being pushed to become increasingly smaller, thus, a typical faucet takes a longer length of time to fill a pot. A user may be holding a heavy pot for quite awhile during the filling process. Cleaning also is not as effective.

Attempts have been made in the prior art to provide a multi-functional kitchen faucet or other spray head. For example, U.S. Pat. No. 7,070,125 discloses a faucet or pull-out spray head having multiple outlets, wherein the spray is controlled by a rocker or sliding switch, and including spring-biased features. One function is a stream outlet with a reservoir and removable aerator assembly in the center of the faucet head. The other functions are from two other annular spray outlets, each having a plurality of holes and orifices arranged in a first and second annular ring around the stream outlet. The first annular spray produces a higher velocity/harder spray versus the lower velocity/softer spray produced from the second annular ring in comparison to the column of flow through the stream outlet. A similar rocker mechanism can be found in U.S. Pat. No. 5,937,905 which teaches a faucet having at least two different outlets and using a three-way valve with means for blocking flow through the second and third outlets and changing the spray pattern by use of the rocker.

U.S. Patent Application Publication No. 2011/0088784 A1 teaches a multi-function faucet wand that is removable from a spout that has a mode control valve to regulate between an aerated stream and spray mode and a second flow control valve to regulate between high and reduced flow rate.

U.S. Patent Application Publication No. 2010/0213282 A1 includes a rotating showerhead having a plurality of spray outlets with up to four spray modes controlled by a ring on the showerhead where the outlets of adjacent spray modes are disposed perpendicularly to each other and to the pivot axis of the showerhead.

U.S. Patent Application Publication No. 2007/0221757 discloses a faucet wand having a plurality of conduits with a diverter valve dividing fluid flow between two conduits.

While various attempts have been made in the bath/shower head area to incorporate different flow patterns for human washing, kitchen faucets have fewer options, and to the extent attempts have been made to increase the functionality of kitchen faucets as noted above, the attempts include complex designs, and in some cases are difficult to operate in use. They also do not all provide advantageous flow patterns and increased functionality to improve the faucet's function even with low flow faucets so as to improve cleaning and use of the kitchen faucet.

Accordingly, there is a need in the art to continue to improve the functionality and features of kitchen faucets to render them more useful and user-friendly to consumers.

BRIEF SUMMARY OF THE INVENTION

The invention includes a kitchen faucet or faucet assembly having a spray head with multifunctional features. It includes a rotatable face plate area providing multiple spray functions, while still providing a standard aerated spray. The spray head may incorporate a pause and/or boost function to provide for enhanced flow for a faster filling function when filling pots or for similar uses.

In one embodiment, the invention includes a faucet assembly having a multifunction spray head, wherein the spray head is capable of providing an aerated spray and at least one spray function, comprising an outer shell; a flow body extending within the shell, having a first end extending out of the shell for attachment to a faucet and a second end in fluid communication with a spray selector assembly, wherein the flow body defines a flow path from the first end of the flow body to a flow selector assembly; the flow selector assembly comprising: a selector valve housing body having at least two valve recesses therein; at least two flow selector valves seated within the recesses in the selector valve housing body; and a rotating selector valve ring capable of rotating around the selector valve housing body to open a selector valve and close the at least one other selector valve for opening a flow path through the flow selector assembly when each selector valve is open; a sprayer seat having a faceplate thereon and having one or more flow diversion conduits aligned with each valve in the selector valve housing body for providing fluid communication from each flow path leaving a selector valve to a sprayer outlet at the end of a flow path through the flow selector assembly or to an aerator outlet at the end of a flow path through the flow selector assembly; and an outer selector ring comprising a selector assembly seat for seating the flow selector assembly and the sprayer seat and engaging the rotating selector valve ring; and wherein the flow body provides a flow path through the flow body and the selector valves provide selected flow paths sufficient to provide at least an aerator flow path to an aerator outlet, and at least one flow path to alternate spray function outlet, wherein rotation of the outer selector ring engages the selector assembly seat and the rotating selector valve ring to change the at least one spray function.

The at least one spray function may be selected from a shower sprayer, a misting sprayer, and a jet sprayer. The faucet in one embodiment is a kitchen faucet. There are preferably at least three spray functions in addition to an aerator flow function, including a shower spray, a misting spray and a jet spray.

The faucet assembly may have at least four flow selector valves seated within at least four of the recesses in the selector housing body for providing four flow paths, comprising an aerator path to an aerator outlet, a shower sprayer path to at least one shower sprayer outlet, a misting sprayer path to a misting sprayer outlet and a jet sprayer path to a jet sprayer outlet.

Flow from the selector housing body flow selector valves preferably passes through a corresponding flow diversion conduit for directing flow to the aerator and sprayer outlets.

The flow path of the flow body may be interrupted by at least one valve. For example, the at least one valve interrupting the flow path may be a boost valve for increase flow rate. The at least one valve interrupting the flow path may also be a pause valve. The at least one valve may further be a valve for switching between an aerator flow path and a flow path to the flow selector assembly for selecting one or more sprayer functions. Any of such valves may be used alone or in combination with another such valve using the principles and disclosure provided herein. The valves may provide a boost function to enhance water flow for filling pots. In addition, the valve may include a toggle switch for changing between aerated spray and one or more spray functions.

There are preferably four flow selector valves, each of which has a valve head, a valve stem and a tensile member and wherein the valve head is capable of being depressed by the rotating selector valve ring or being expanded in a recess within the rotating selector valve ring. The face plate may be configured to receive a brush head attachment.

The outer selector ring may have one or more tactile features for selecting a spray function. The outer selector ring may also have one or more icons, each for identifying a corresponding spray function.

The jet sprayer function may comprise a curved jet head and a divergent spray outlet recessed in the spray head. The spray head may connect to a pull-out sprayer hose within a faucet housing. The faucet may also include a mixing valve and a handle with a flow adjustment valve therein.

The invention also includes a spray head capable of an aerated spray and at least one spray function, comprising an outer shell; a flow body extending within the shell, having a first end extending out of the shell for attachment to a faucet and a second end in fluid communication with a spray selector assembly, wherein the flow body defines a flow path from the first end of the flow body to a flow selector assembly; the flow selector assembly comprising: a selector valve housing body having at least two valve recesses therein; at least two flow selector valves seated within the recesses in the selector valve housing body; and a rotating selector valve ring capable of rotating around the selector valve housing body to open a selector valve and close the at least one other selector valve for opening a flow path through the flow selector assembly when each selector valve is open; a sprayer seat having a faceplate thereon and having one or more flow diversion conduits aligned with each valve in the selector valve housing body for providing fluid communication from each flow path leaving a selector valve to a sprayer outlet at the end of a flow path through the flow selector assembly or to an aerator outlet at the end of a flow path through the flow selector assembly; and an outer selector ring comprising a selector assembly seat for seating the flow selector assembly and the sprayer seat and engaging the rotating selector valve ring; and wherein the flow body provides a flow path through the flow body and the selector valves provide selected flow paths sufficient to provide at least an aerator flow path to an aerator outlet, and at least one flow path to alternate spray function outlet, wherein rotation of the outer selector ring engages the selector assembly seat and the rotating selector valve ring to change the at least one spray function.

In one embodiment, the spray head is used particularly for a kitchen faucet. The at least one spray function may be selected from an aerated spray, a shower spray, a misting spray, and a jet spray. Preferably, there are four selector valves in four recesses within the selector valve housing body to provide an aerator flow path to an aerator outlet, at least one shower sprayer path to at least one shower sprayer outlet, a misting sprayer path to a misting sprayer outlet and a jet sprayer path to a jet sprayer outlet.

The flow path of the flow body may be interrupted by at least one valve. For example, the at least one valve interrupting the flow path is a boost valve for increase flow rate. The at least one valve interrupting the flow path may also be a pause valve. The at least one valve may also be a valve for switching between an aerator flow path and a flow path to the flow selector assembly for selecting one or more other sprayer functions.

Each of the at least two flow selector valves preferably has a valve head, a valve stem and a tensile member and wherein the valve head is capable of being depressed by the rotating selector valve ring or being expanded in a recess within the rotating selector valve ring.

The face plate may also be configured to receive a brush head attachment. The outer selector ring may have one or more tactile features for selecting a spray function. The outer selector ring has one or more icons, each identifying a corresponding spray function. The jet sprayer function may comprise a curved jet head and a divergent spray outlet recessed in the spray head. The outer selector ring comprises a rotating selection ring mounted on the selector assembly seat that rotates with the selector assembly seat when turning the outer selector ring.

In a further embodiment, the invention includes a multi-function spray head for a faucet, wherein the spray head is capable of an aerated spray and at least one spray function, comprising an outer shell; a flow body extending within the shell, having a first end extending out of the shell for attachment to a faucet and a second end in fluid communication with a spray selector assembly, wherein the flow body defines a flow path from the first end of the flow body to a flow selector assembly; the flow selector assembly comprising: a selector valve housing body having at least two valve recesses therein; at least two flow selector valves seated within the recesses in the selector valve housing body; and a rotating selector valve ring capable of rotating around the selector valve housing body to open a selector valve and close the at least one other selector valve for opening a flow path through the flow selector assembly; a sprayer seat having a faceplate thereon and comprising flow diversion conduits for receiving flow from each selector valve when open; and an outer selector ring, comprising a selector assembly seat for seating the flow selector assembly and engaging the rotating selector valve ring; and wherein the flow body provides a flow path through the flow body and the selector valves provide selected flow paths sufficient to provide at least two flow paths to at least two flow outlets, wherein rotation of the outer selector ring engages the selector assembly seat and the rotating selector valve ring to change at least one spray function, and wherein the flow path of the flow body is interrupted by a valve for switching between the aerator flow path and a flow path to the flow selector assembly for selecting one or more other sprayer functions.

In this embodiment, the face plate may be configured to receive a brush head attachment. The outer selector ring may also have one or more tactile features for selecting a spray function. The outer selector ring may have one or more icons, each identifying a corresponding spray function. The jet sprayer function comprises a curved jet head and a divergent spray outlet recessed in the spray head.

In a further embodiment, the invention includes a multi-function spray head for a faucet, wherein the spray head is capable of an aerated spray and at least one spray function, comprising an outer shell; a flow body extending within the shell, having a first end extending out of the shell for attachment to a faucet and a second end in fluid communication with a spray selector assembly, wherein the flow body defines a flow path from the first end of the flow body to a flow selector assembly; the flow selector assembly comprising: a selector valve housing body having at least two valve recesses therein; at least two flow selector valves seated within the recesses in the selector valve housing body; and a rotating selector valve ring capable of rotating around the selector valve housing body to open a selector valve and close the at least one other selector valve for opening a flow path through the flow selector assembly; a sprayer seat having a faceplate thereon and comprising a corresponding flow diversion conduit for each selector valve; and an outer selector ring comprising a selector assembly seat for seating the flow selector assembly and engaging the rotating selector valve ring, wherein the flow body provides a flow path through the flow body and the selector valves provide selected flow paths sufficient to provide at least two flow paths to at least two flow outlets and wherein rotation of the outer selector ring engages the selector assembly seat and the rotating selector valve ring to change at least one spray function, and wherein the outer selector ring has one or more icons, each identifying a corresponding spray function.

In this embodiment, there may be four selector valves in four recesses within the selector valve housing body to provide an aerator flow path to an aerator outlet, at least one shower sprayer path to at least one shower sprayer outlet, a misting sprayer path to a misting sprayer outlet and a jet sprayer path to a jet sprayer outlet.

The flow path of the flow body may be interrupted by at least one valve. The at least one valve may be a valve for switching between an aerator flow path and a flow path to the flow selector assembly for selecting one or more other sprayer functions. The spray head may also comprise a pause valve.

Preferably each of the at least two flow selector valves has a valve head, a valve stem and a tensile member and wherein the valve head is capable of being depressed by the rotating selector valve ring or being expanded in a recess within the rotating selector valve ring.

The face plate may be configured to receive a brush head attachment. The outer selector ring may have one or more tactile features for selecting a spray function. The jet sprayer function may comprise a curved jet head and a divergent spray outlet recessed in the spray head. The flow body may have an upper section and a lower section. The flow body may also be interrupted by a valve for switching between an aerator flow path and a flow path to the flow selector assembly for selecting one or more other sprayer functions in its lower section and by a pause valve in its upper section.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
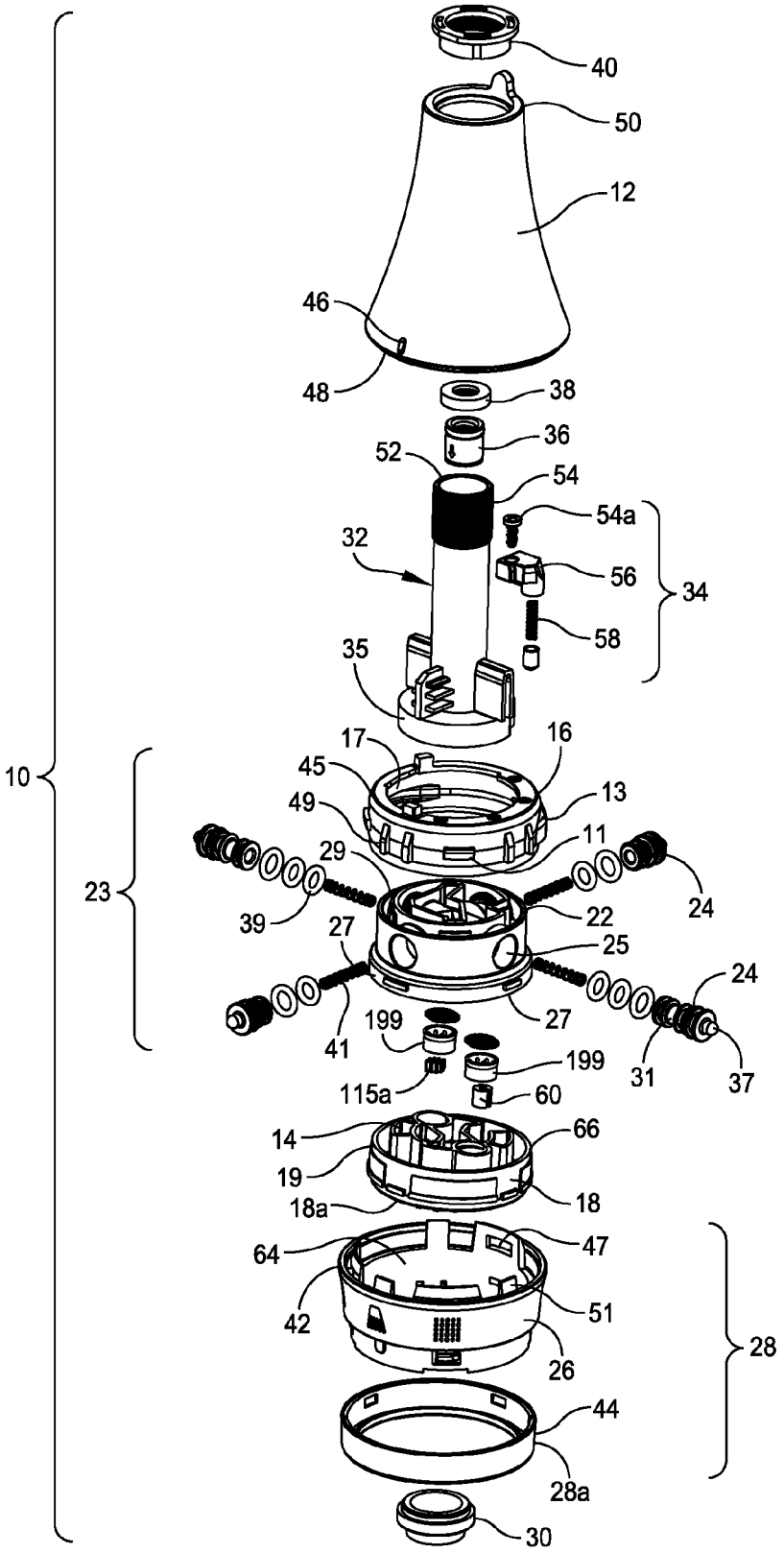
FIG. 1 is a exploded view of one embodiment of a kitchen faucet spray head of the invention having an outer selector ring.
Figure 4:
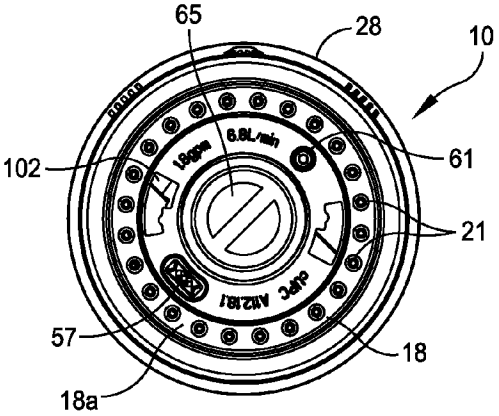
FIG. 4 is a bottom plan view of the spray head of FIG. 1.
Figure 3:
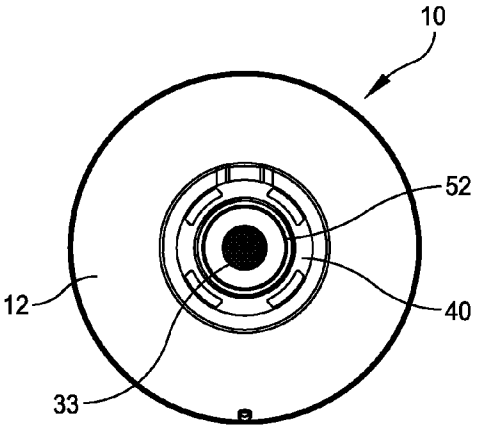
FIG. 3 is a top plan view of the spray head of FIG. 1.
Figure 2:
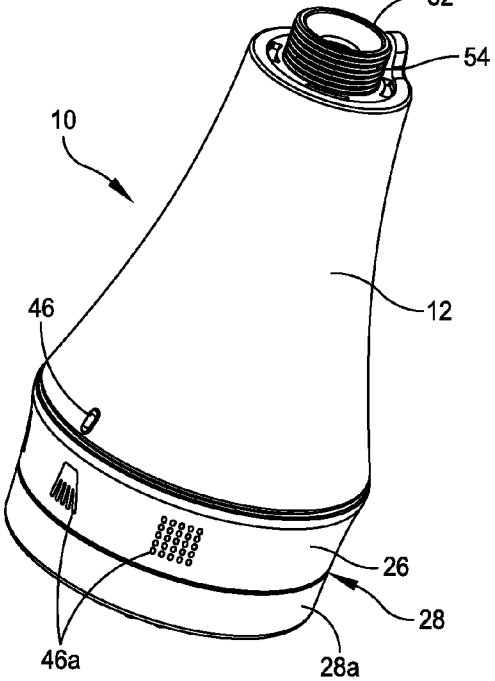
FIG. 2 is a perspective view of the spray head of FIG. 1.
Figure 4A:
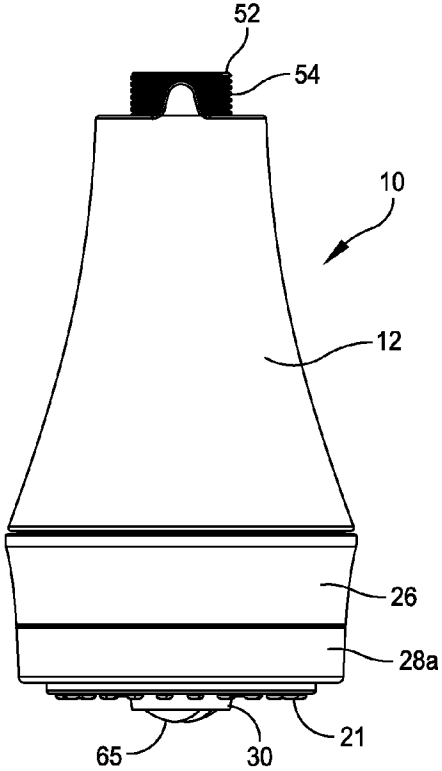
FIG. 4A is a side elevational view.
Figure 4D:
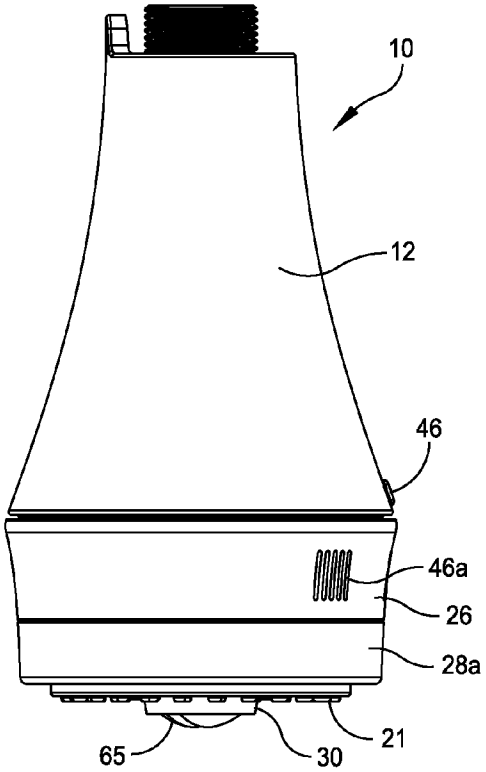
FIG. 4D is a further side elevational view showing a different icon representing a different tactile feature for a different functional feature than that of FIG. 4C.
Figure 4B:
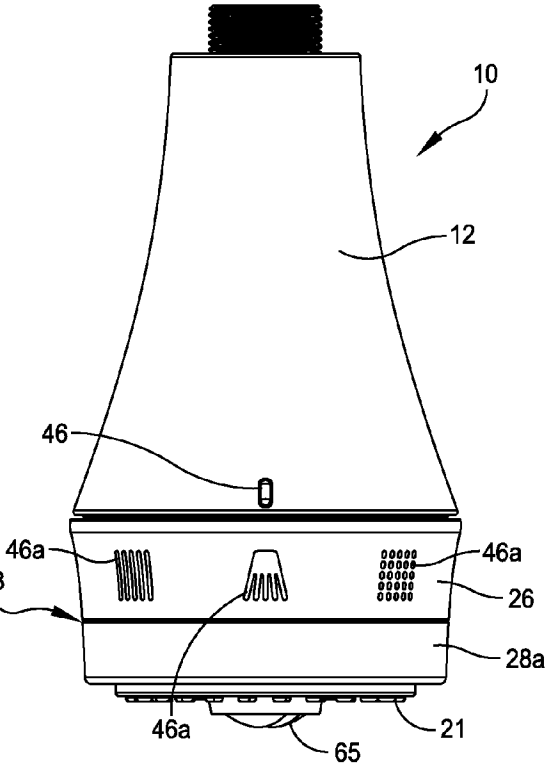
FIG. 4B is a further side elevational view showing three icons representing tactile features of the spray head of FIG. 1 and corresponding certain functional features.
Figure 4C:
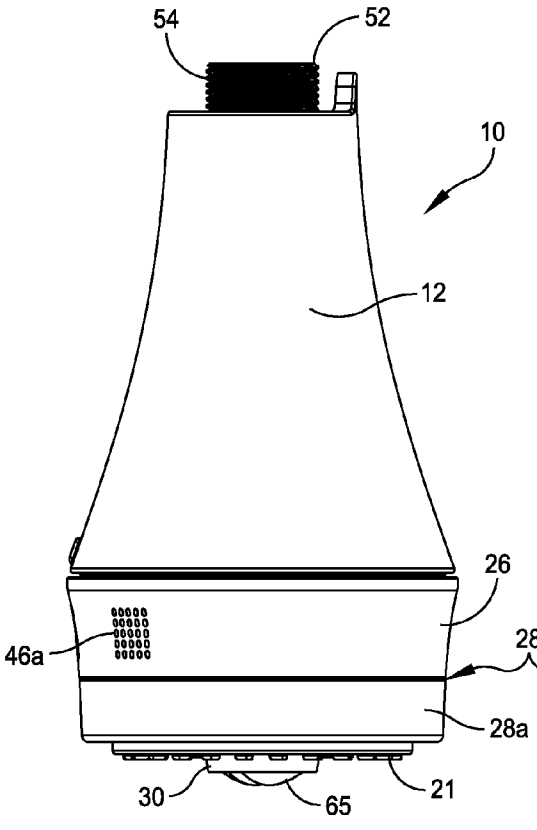
FIG. 4C is a further side elevational view showing an icon representing a tactile feature of the spray head of FIG. 1 for a functional feature.

The spray heads of the invention herein offer a powerful jet stream through various embodiments herein, which can clean a sink and dishes more efficiently and effectively. In addition, the invention may provide a pause and/or boost button feature in one embodiment to offer stopping of flow or a high flow rate over the regular use functions. Such a pause or boost functions can be useful in controlling the flow or speeding up the ordinary time it would take with lower flow water to fill a pot. An additional toggle feature can also be provided to switch from a aerator flow to a multifunctional flow easily in use as an alternative to selecting the aerator function by an outer selector ring as described further below.

The spray heads of the invention are shown in the attached drawings. The various embodiments include multiple spray modes and, in some embodiments, a toggle function for aeration or an additional push button feature for pausing or boosting flow. The multiple spray modes may include, but are not limited to a shower spray, an aerator mode, a point jet spray and a mist spray, There is an outer selector ring on the bottom of spray head having tactile features, to allow for selection of a flow pattern to be switched between various spray modes such as shower spray, jet spray, aerator and/or mist spray modes. Icons corresponding to the tactile features may be provided for easy use, wherein each icon corresponds to a tactile feature representing a particular spray function.

The drawings herein are provided for ease of understanding preferred embodiments. Word such as "upper" and "lower," "inner" and "outer," "left" and "right," "front" and "back," "inwardly" and "outwardly," "top" and "bottom" and words of similar import refer to directions in the drawings and are provided for ease of understanding of the invention detailed description with reference to the drawings. They are not intended to be limiting.

Figure 9:
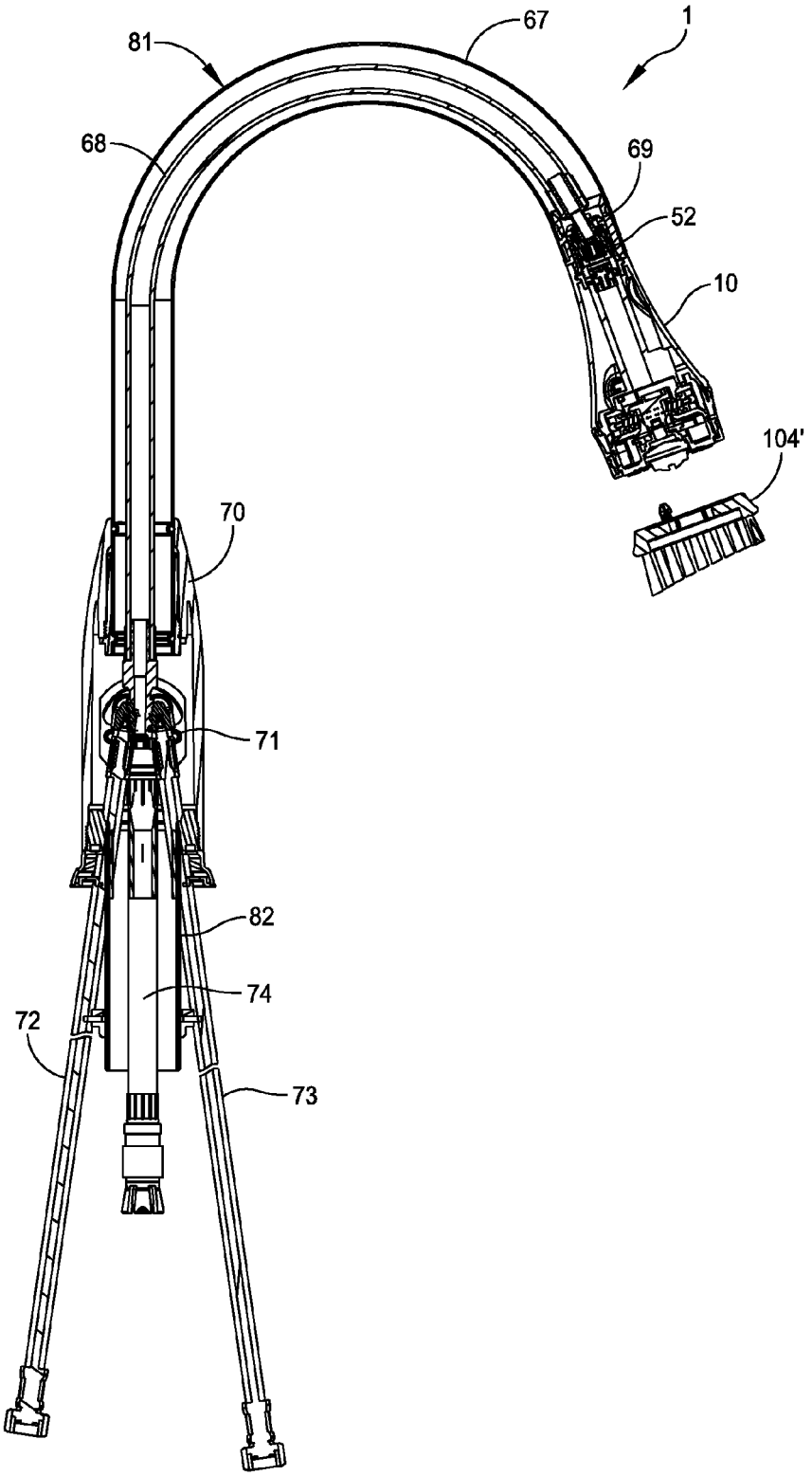
FIG. 9 is a longitudinal cross-sectional view of a kitchen faucet having a spray head according to one embodiment installed thereon with an optional brush feature.
Figure 10:
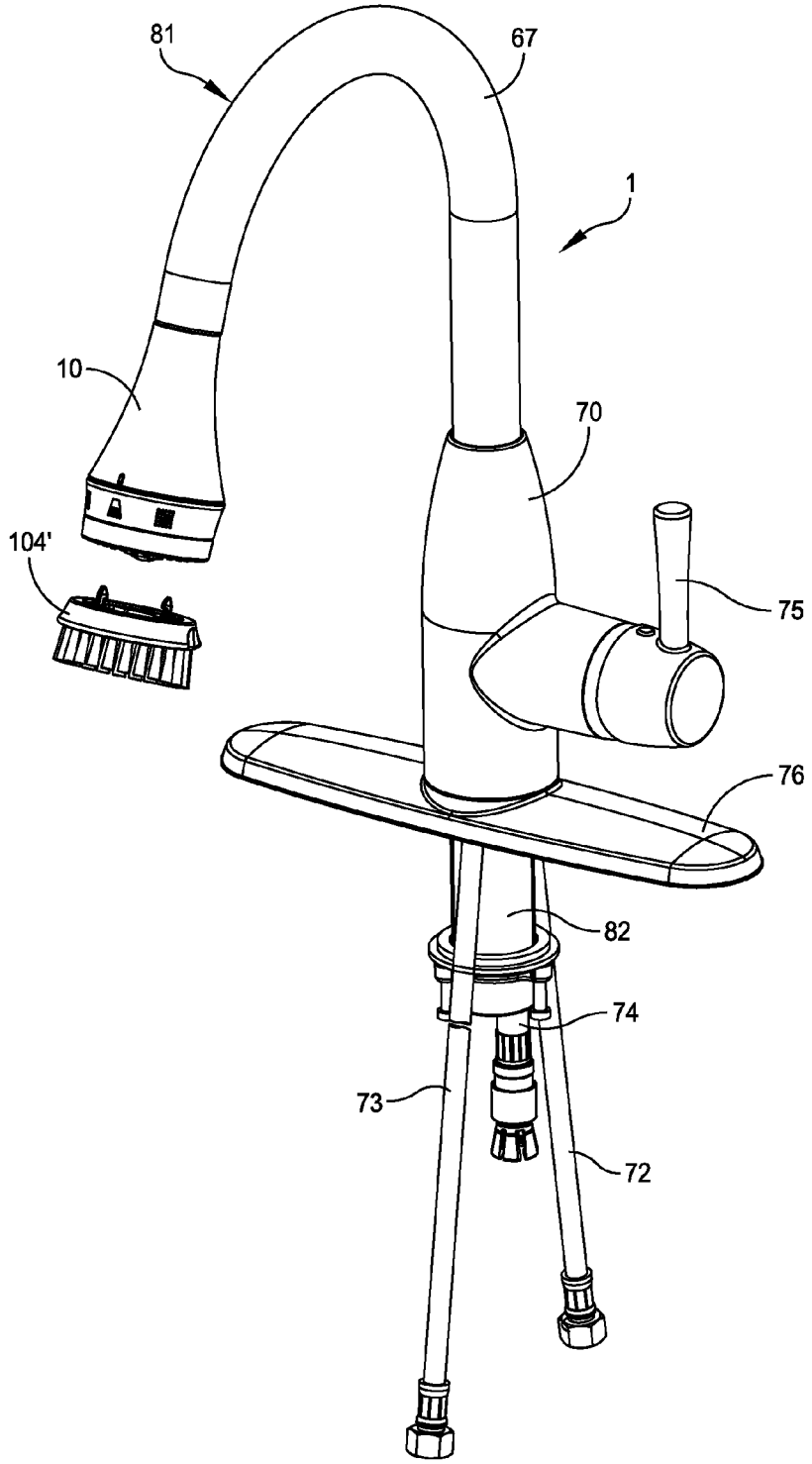
FIG. 10 is a perspective view of a kitchen faucet having the faucet spray head of FIG. 9 installed thereon.
Figures 11, 11A:
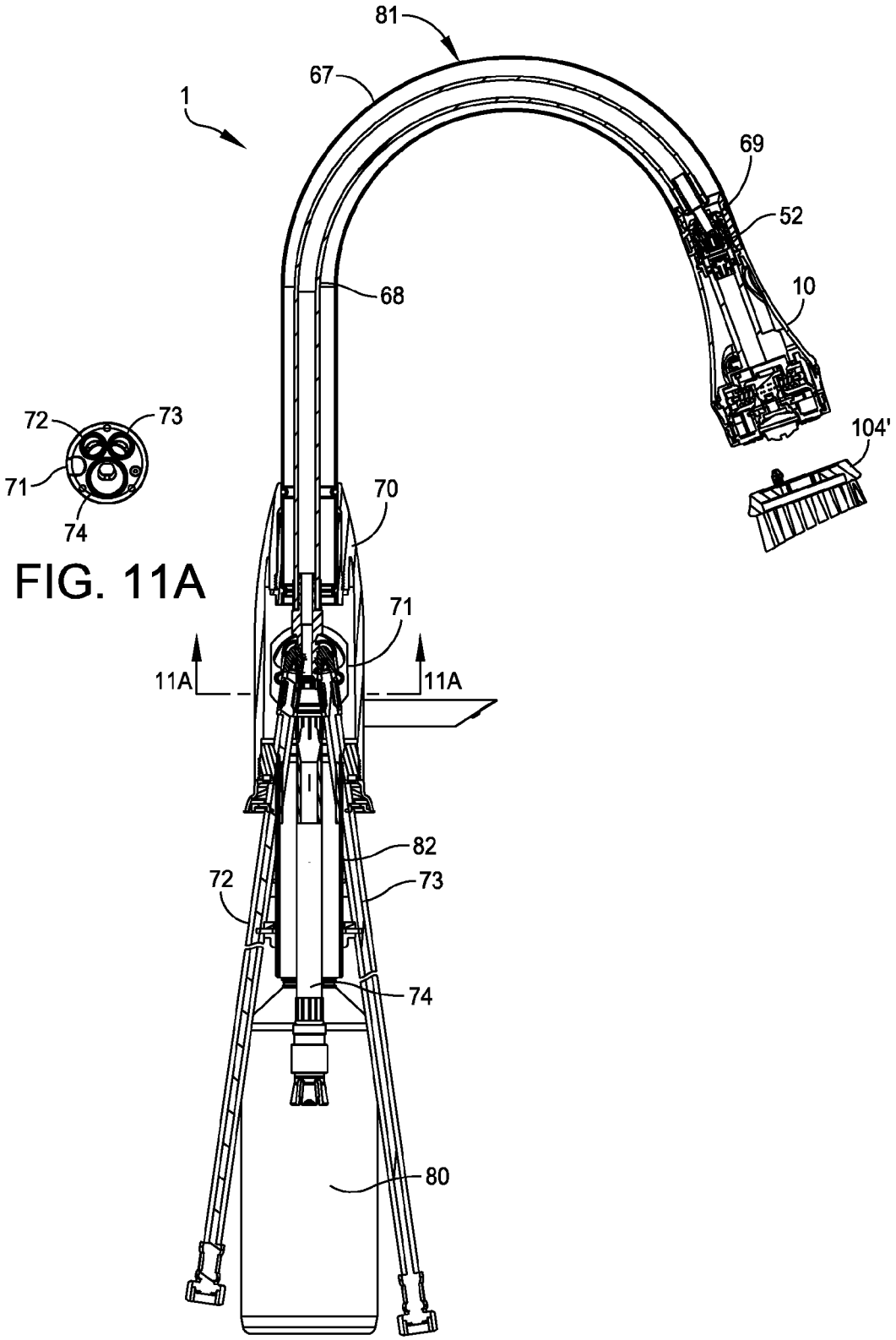
FIG. 11 is a longitudinal cross-sectional view of the kitchen faucet assembly having the spray head of FIG. 1, partly disassembled to show an optional brush feature and an optional soap dispenser feature.
FIG. 11A is a transverse cross-sectional view of the mixing valve of the faucet of FIG. 11 taken along line 11A-11A.
Figure 12:
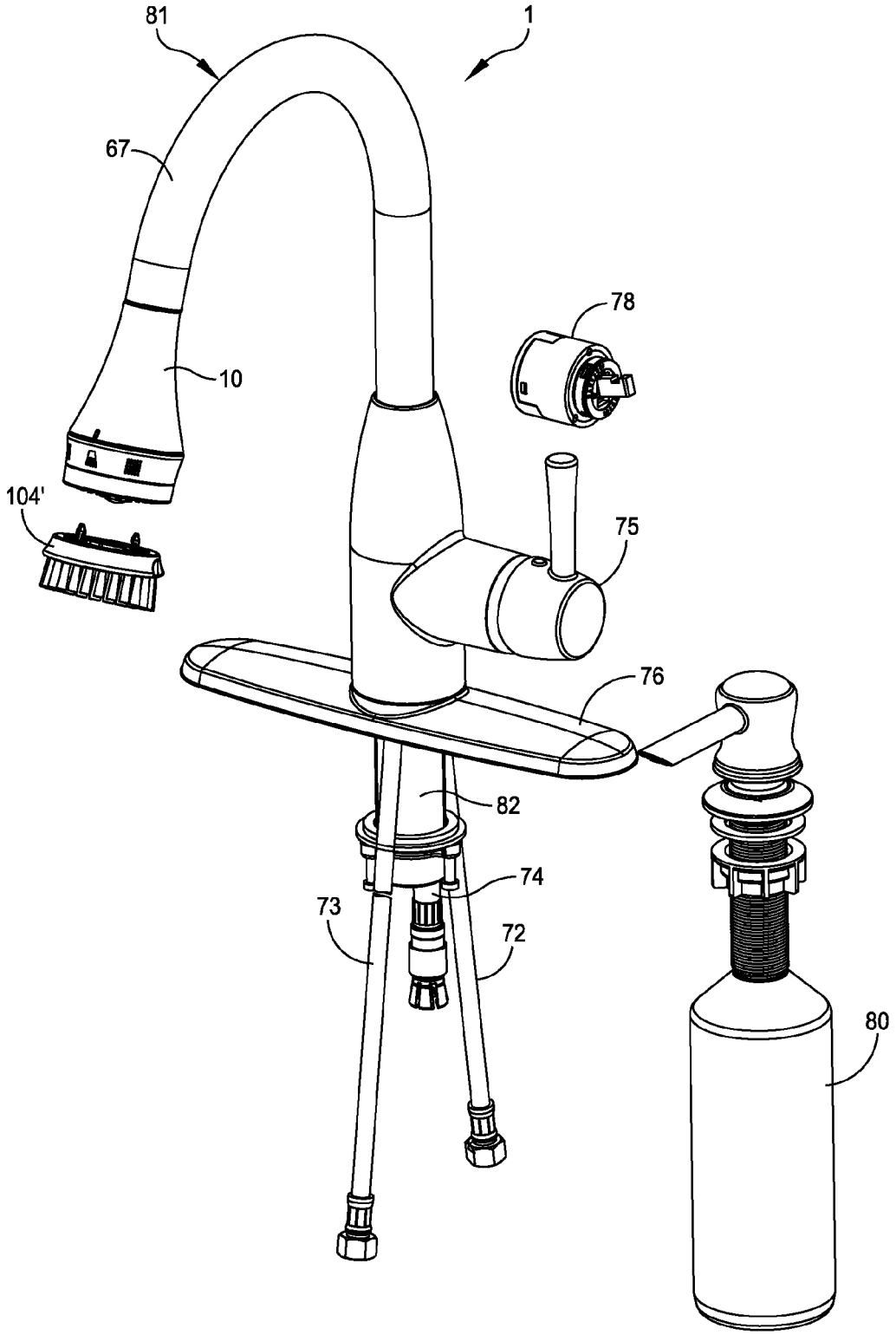
FIG. 12 is a perspective view of the kitchen faucet assembly of FIG. 11 having the faucet spray head of FIG. 1 installed thereon, partly disassembled to show the temperature and flow control valve inside the handle for introducing water at selected temperatures and flow volumes as well as an optional brush and soap dispenser feature.

In a first embodiment, herein as shown in FIGS. 1-8 and 13, a spray head with multiple spray functions is shown. The spray head is designed for a kitchen faucet as shown in FIGS. 9 and 10 and may be part of a kitchen faucet assembly with additional features as shown in FIGS. 11 and 12 as well, but may be adapted for other faucets, such as a lavatory or industrial sink without departing from the scope of the invention herein.

The spray head, generally referred to as spray head 10, has an outer shell 12. The outer shell may be formed so as to be of a variety of preferably decorative materials, whether a metallic cast finish, a plastic molded design color or metallic look or the like. The cover or face plate may also be a molded metallic structure, but is preferably a molded polymeric material having a cast metallic finish. Such materials are well known in the art of exterior coverings for faucet assemblies, and any such suitable outer faucet cover material may be used to form the outer shell 12. The outer shell may include polymeric materials, which may be unfilled or a filler polymeric or composite material having a powder type or fibrous reinforcing material therein. Examples of polymeric material for use in such unfilled and filled formation of a shell, include, but are not limited to polyamides (PA), polyphenylene sulfides (PPS), or a polyphenylene oxide (PPO), polystyrene-butadiene-styrenes (SBS), polyacrylonitrile-butadiene-styrenes (ABS), polyimides (PI), polyarylenes (polyetherether ketone (PEEK), polyether ketone (PEK), polyether ketone ketone (PEKK) and the like), polyethylene sulfones (PES), polyetherimides (PEI), polytetrafluoroethylene (PTFE), fluoroplastics (FEP and PFA), polyethylenes (PE), polypropylenes (PP), polyvinylchloride (PVC), polyoxyalkylenes (i.e., polyacetals) such as polyoxymethylene (POM), polyoxyethylenes (POE), polyoxybutylenes (POB), etc., and styrene-maleic-anhydrides (SMA)). The outer shell may be formed also of alloys, blends and/or copolymers of these polymeric materials, provided the materials provide adequate strength and properties for carrying out their function as an outer shell. Composite materials may include a combination of polymeric materials as noted above with fibrous and/or particulate materials such as glass fibers, carbon fibers, aramid fibers, Kevlar®, mica, carbon powder, and other fillers known in the art. Preferred materials include PA, POM, PPS and PPO and copolymers, combinations and functionalized polymers of these materials.

The shell is seated so as to fit over an edge 42 of an outer selector ring 28. The selector ring 28 includes on its outer surface 44 one or more tactile features 46 which can be used to select corresponding functional features of the spray head. Preferably, there is at least one, preferably at least two and more preferably at least three such tactile features. As shown in the embodiment of FIG. 1, there is one such feature which can be aligned when a tactile feel for or click is made to correspond to three separate functions, one for selecting a misting spray, one for selecting a direct jet spray and one for selecting a shower spray. The aerator spray function is the default spray when the other three spray features are not selected. In addition, as shown, icons 46*a* can be used to work with one or more tactile features, clicks or the like for identifying a corresponding spray function. Three such icons are shown in the embodiment of FIG. 1.

The inner space 48 of the shell is able to house the interior parts of the spray head. At an upper end 50 of the shell 12, an attachment fitting 40 is provided for use in retaining a check valve 36 and o-ring 38 to seal the upper end 50 of the shell and for connection to a faucet. The check valve 36 provides for one-way flow so as to prevent backflow of water through the spray head. An interior flow body 32 is mounted within the spray head and passes through the fitting 40 so as to be connectable at its first end 52 through screw threads 54 or other suitable connecting feature to a faucet neck as described further below. A mounting feature 34 having a mounting screw 54*a* and housing 56 with a tensile feature 58 connects to a receiving area of the spray selector housing body 22 (described further below) which helps retain the housing in place during functional selection.

The ring-shaped sprayer seat 18 has an exterior surface 19 configured for snapping into the inside 64 of the selector assembly seat 26 of the outer selector ring and an upper end 66 for engaging the bottom 27 of the spray selector housing body 22. The features of the exterior 19 may be formed so as to snap easily into the selector assembly seat 26. The features may be varied in accordance with the desired design. Sprayer seat 18 also incorporates on a lower portion thereof the faceplate 18*a* for the spray head having various outlets therein for providing flow for the shower spray, jet spray, mist spray and aerator spray leaving the spray head in use.

The spray selector housing body has internally one or more flow paths that are in fluid communication with corresponding flow diversion conduits 14 which may be molded as part of or ultrasonically welded within the sprayer seat 18 to direct flow from the valve housing body leaving a particular selected valve into a selected flow path after a flow pattern is selected by turning the outer selector ring as described below.

A selector assembly 23 is also provided which includes a rotating selector valve ring 16 that is seated over the selector valve housing body 22. Four selector valves 24 are seated within recesses 25 formed in the housing body 22 which provide flow paths within the housing and are part of the selector assembly. The lower end 27 of the housing body is configured to receive provide fluid communication to the flow diversion conduits 14 within the spray seat 18 body. Alternatively, in place of flow diversion conduits, a flow selection disc directing flow may also be used. As shown, however, flow diversion conduits can receive flow directly from the selector valve housing body in the selected flow paths to communicate flow to a designated flow outlet. Thus, the flow diversion conduits 14 direct flow from an open valve to the corresponding outlet path for the various spray functions as will be described further below. The housing body 22 has an upper end 29 configured to sit within an interior space 33 of the flow body 32 at a second end 35 thereof.

In the selector assembly 23, the individual selector valves 24 each have a valve body or valve stem 31*a* valve head 37 on an exterior end of the valve 24, at least one sealing ring 39, such as an o-ring, and a tensile member 41, such as a spring in the case of a spring loaded valve as shown. Each of four such valves 24 are positioned and spaced within the selector valve housing body 22 within corresponding recesses 25.

The rotating selector valve ring 16 is formed so as to have an interior surface 17 that is primarily smooth, but has recesses 43 formed by bump out portions or other features 13 on the exterior 45 of the rotating selector valve ring 16. It should be understood that the exterior of the ring 16 may be smooth and recesses built in another manner inside the body of the ring 16 if desired. The rotating ring has one or more locking features 11 on its exterior 45 as well. As shown herein, such features are snaps to lock with mating snap features 47 on the selector assembly seat 26 of the outer selector ring 28. Thus, turning the outer selector ring 28*a*, which is locked also to the selector assembly seat 26 within the outer selector ring 28 turns the selector assembly seat 26 as well, and also turns the rotating selector ring by virtue of locking features 11,47. Such turning then changes the selector valve settings which changes the spray function of the spray head.

As the rotating selector valve ring 16 turns, the locking features 11, 47 are engaged as are exterior features 49 of the rotating ring 16 that sit around upwardly extending fingers 51 on the selector valve seat 26. When the head 37 of a valve 24 fits within one of the interior recesses 43 on the interior surface 17 of the rotating ring, the extra area enables the tensile member 41 of the valve 24 to expand and the valve head 37 to compress against the interior surface 17 in the recess 43. This allows for the valve to open at the end opposite the head so that flow will pass through the open valve into one or more flow paths to spray outlets.

Figure 5A:
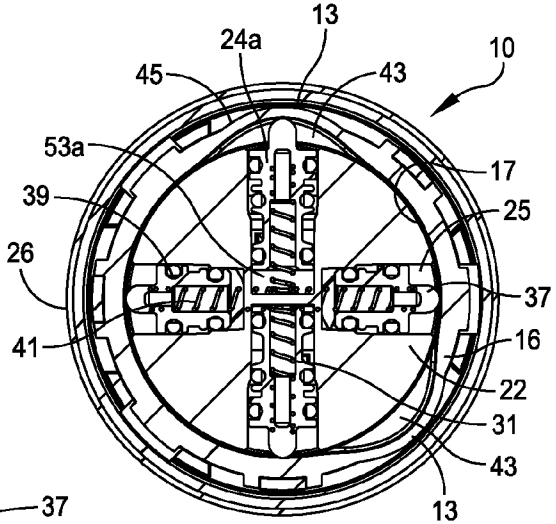
FIG. 5A is a transverse cross-sectional view of the spray head of FIG. 5 taken along line 5A-5A showing the faucet spray head in the shower spray mode.
Figure 5:
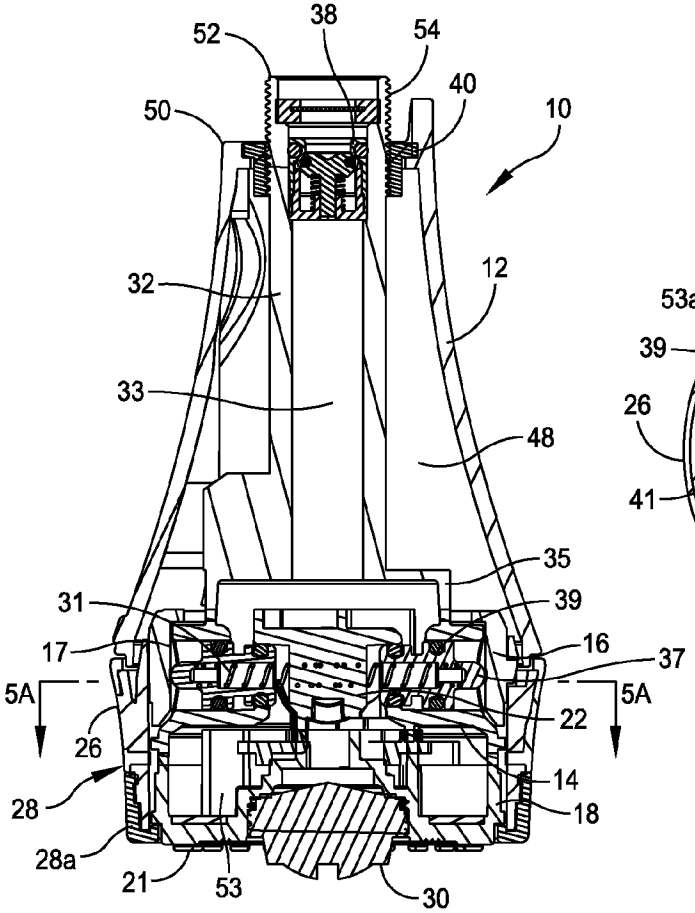
FIG. 5 is a longitudinal cross-sectional view of the spray head of FIG. 1 showing the faucet spray head in the shower spray mode.

With reference to FIGS. 5 and 5A, a first spray mode is shown in the form of shower spray. Water flowing through the interior 33 of flow body 32 enters the top of rotating ring 16 and into the top of the selector valve housing body 22. The rear valve 24*a* shown in FIG. 5A has a head 37 which enters recess 43. That valve opens and flow can pass around the valve and through open the corresponding flow diversion conduit 14 which directs flow when such valve is open through a shower sprayer flow path 53*a* to the area 53 above the shower sprayer outlets 21 within the sprayer seat 18.

Figure 6A:
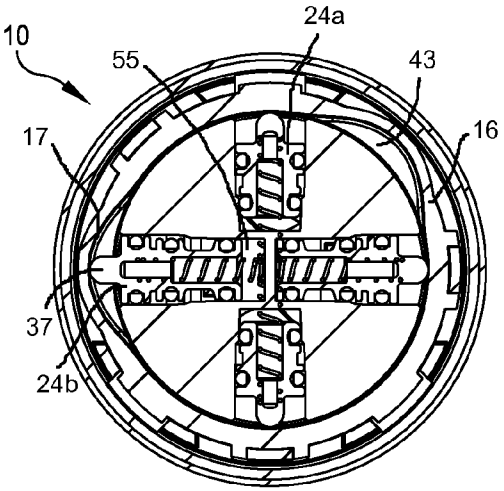
FIG. 6A is a transverse cross-sectional view of the spray head of FIG. 6 showing the faucet spray head in the jet spray mode taken along line 6A-6A.
Figure 6:
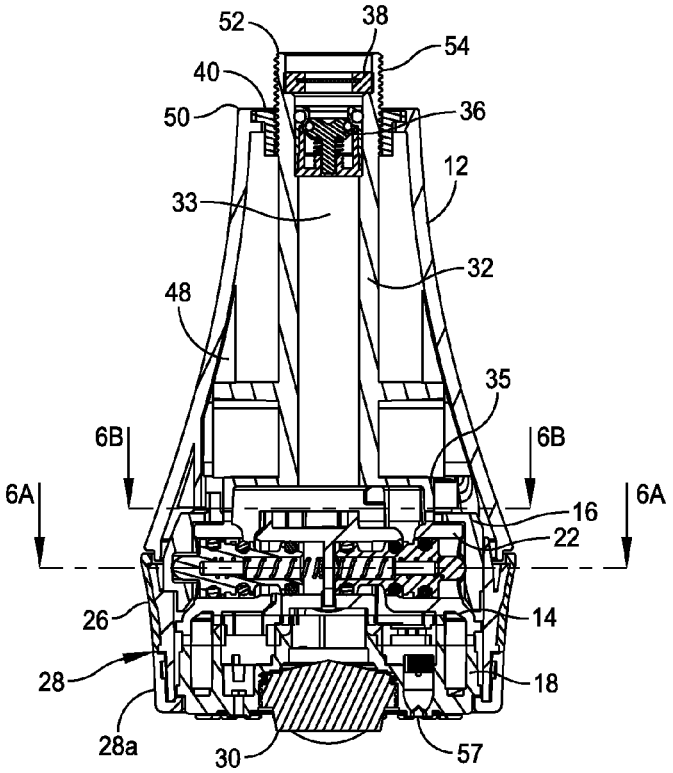
FIG. 6 is a longitudinal cross-sectional view of the spray head of FIG. 1 showing the faucet spray head in the jet spray mode.
Figure 6B:
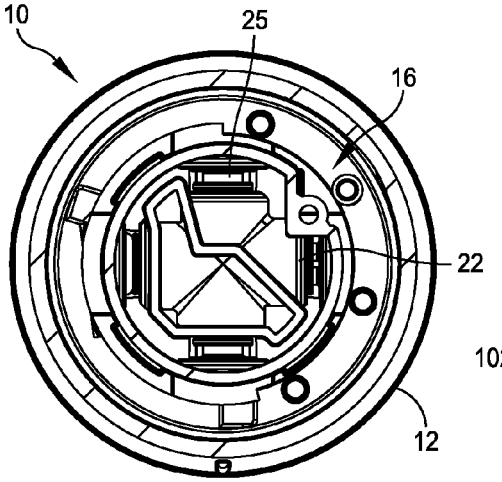
FIG. 6B is a transverse cross-sectional view of the spray head of FIG. 6 in the mode shown in FIG. 6 taken along line 6B-6B.

With reference to FIGS. 6 and 6A, the selection ring 28*a* of outer selector ring 28 is turned again turning the selector valve seat 26 in the outer selector ring and also turning rotating selector valve ring 16 so that the rear valve 24*a* is closed as are other valves with the exception of the valve 24*b* on the left in FIG. 6B which has a head 37 that engages the interior surface 17 of the rotating selector valve ring 16 in the recess 43. As shown in FIG. 6, flow now can pass through the opening left by movement of valve 24*b* into jet path 55 to jet outlet 57.

Figure 7:
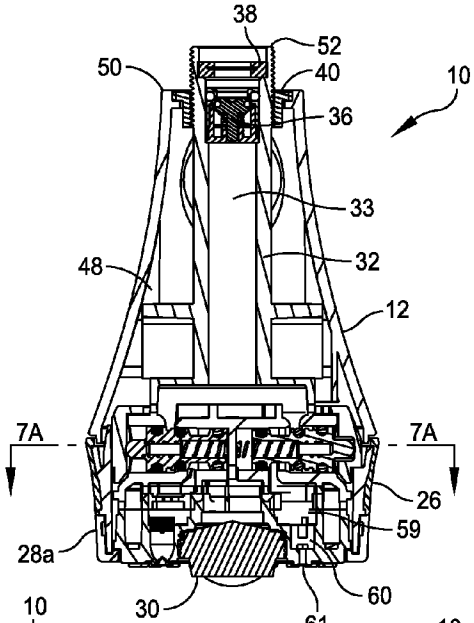
FIG. 7 is a longitudinal cross-sectional view of the spray head of FIG. 1 showing the faucet spray head in the mist water spray mode.
Figure 7A:
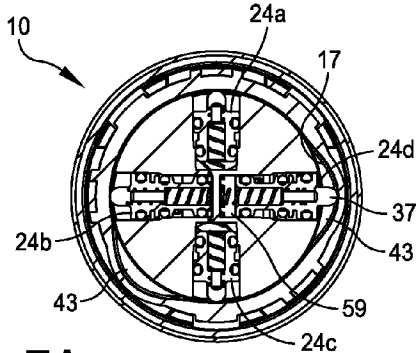
FIG. 7A is a transverse cross-sectional view of the spray head of FIG. 7 showing the faucet spray head in the mist water spray mode taken along line 7A-7A.

With reference to FIGS. 7 and 7A, further turning of outer selector ring 28 turns the rotating selector valve ring 16 so that a selector valve identified as valve 24*d* has its head 37 now within recess 43 and opens a misting flow path 59 through the selector valve body and flow diversion conduit 14 in the selector seat 18 to the misting head 60 and misting outlet 61.

Figure 8:
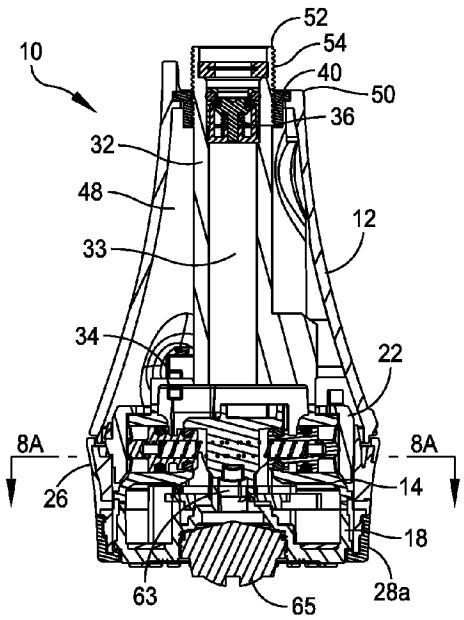
FIG. 8 is a longitudinal cross-sectional view of the spray head of FIG. 1 showing the faucet spray head in the aerator spray mode.
Figure 8A:
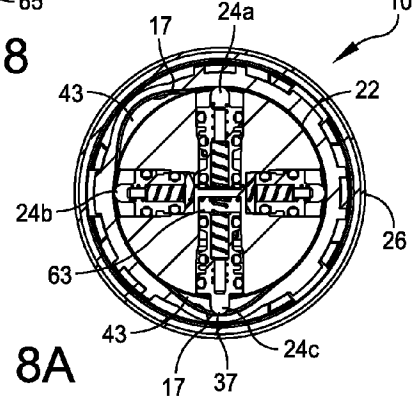
FIG. 8A is a transverse cross-sectional view of the spray head of FIG. 8 showing the faucet spray head in the aerator spray mode taken along line 8A-8A.

Finally, with reference to FIGS. 8 and 8A, further turning of outer selector ring 28 turns the rotating selector valve ring 16 so that the head 37 of selector valve 24*c* is now within recess 43 and an aerator flow path 63 is opened so that flow passes through the flow path to aerator 30 and through aerator outlet 65.

Thus, once the rotating selector valve ring 16 is turned, the selector valves 24*a-d*, which are each driven by the spring force and are responsive to the rotation of the outer selector ring 28 and rotating selector valve ring 27, open and release based on their spring force so that the four selector valves 24 with stems 31 which act as sealing pistons and which are trapped in and move within the recesses 25 or cavities within the valve selector housing individually, create successive selected openings to flow paths to allow the stream of water through the interior 33 of flow body 32 to flow out though the valves to different flow paths to a different outlet(s).

FIGS. 9-12 show example of an embodiment of a faucet assembly 1 according the invention. The embodiment of the spray head 10 described above is shown with one type of faucet 81. The faucet 81 has a housing 67 which may be formed of any of the materials useful to form the outer shell 12 of the spray head 10 and may or may not be formed of the same material as the spray head. The housing 67 is within a supporting base 70 which receives the neck-like housing 67 on one end and encloses an interior hose 68 connected by a hose connection 69 which may be any such connection known or to be developed in the art. The end of the hose near the spray head, preferably has a mating ferrule nut housing interior threads in a standard manner to engage the threads 52 extending through the upper first end 51 of the spray head 10. The other end of the hose is configured to join in fluid communication with a mixed outlet hose 74 coming from a mixing valve 71 which receives flow of water from hot and cold water conduits 72, 73. Such valves are also known in the art and any such mixing valve may be used. The base 70 is situated in an escutcheon 76 and includes a lower mount portion 82 for mounting to a sink or counter. The mounting and sink features are not in and of themselves intended to be limiting and represent only a standard faucet assembly but for the incorporation of the unique spray head 10 herein. It is to be noted that faucet assembly 1 may also be fit so that the conduit introducing mixed water to the hose 68 can be configured so that the spray head is a pull out spray head as well for additional functionality and a magnet head fitting may be incorporated for stability once the spray head is seated in the faucet's neck-shaped housing 67.

The assembly 1 as shown in FIGS. 9-12 may have a single rotatable hot/cold faucet valve 78 situated within the handle 75 for controlling hot and cold mixing in the mixing valve 71 depending on user preference. An optional soap dispenser 80 is also shown which can be mounted adjacent faucet 81 as an optional feature in assembly 1. Further, an optional brush attachment 104' (which will be described with respect to a mountable brush head and spray head assembly 10' below) can be provided.

It should be understood, based on this disclosure, that other faucet assembly configurations and exterior designs as well as two-handle faucets, spread faucets not configured with an escutcheon, alternative mounting, mixing valves, handles, handle valves and valve bodies and other features may be modified and used with the novel spray head 10 herein within the scope of the invention.

Figure 13:
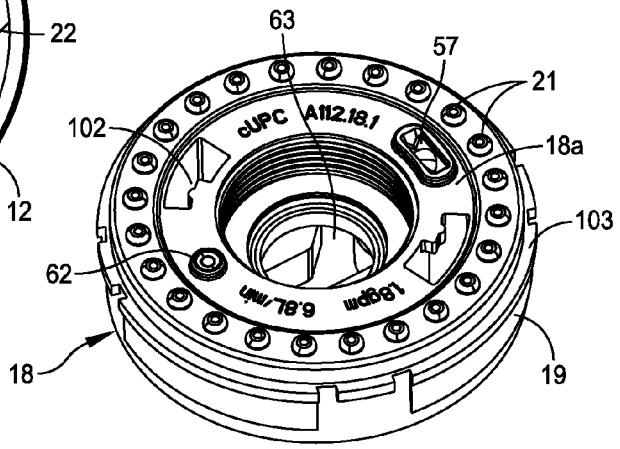
FIG. 13 is a perspective view of a faceplate of the spray head of FIG. 1.
Figure 13E:
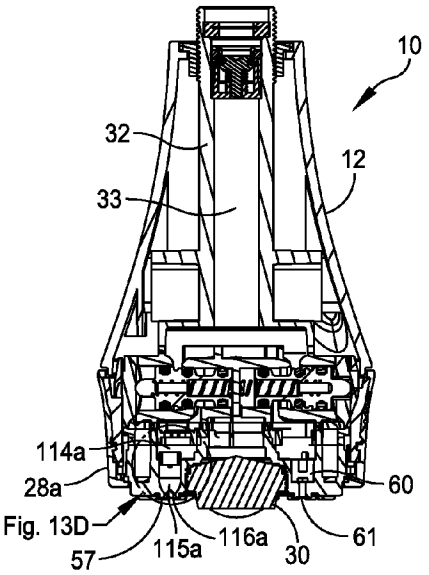
FIG. 13E is a longitudinal view of the spray head of FIG. 13A taken along line 13E-13E.
Figure 13F:
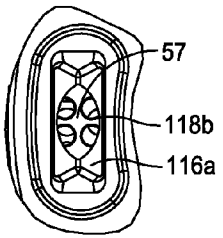
FIG. 13F is an enlarged bottom elevational view showing the jet sprayer.
Figure 13A:
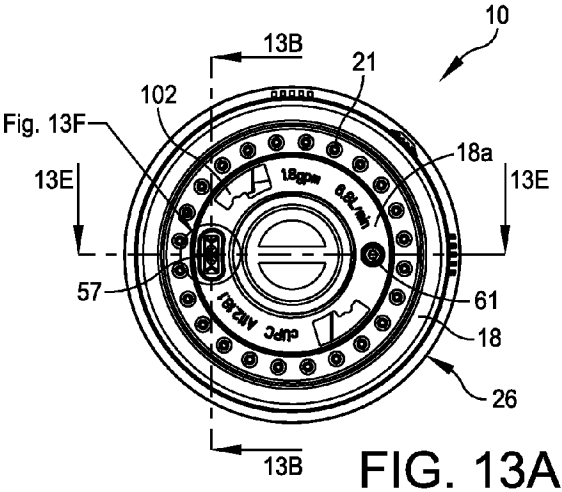
FIG. 13A is a bottom elevational view of the faceplate of FIG. 13 installed on a spray head of FIG. 1.
Figure 13D:
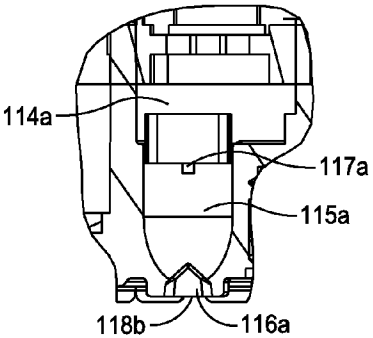
FIG. 13D is an enlarged view of the jet sprayer taken from the view of FIG. 13E.
Figure 13B:
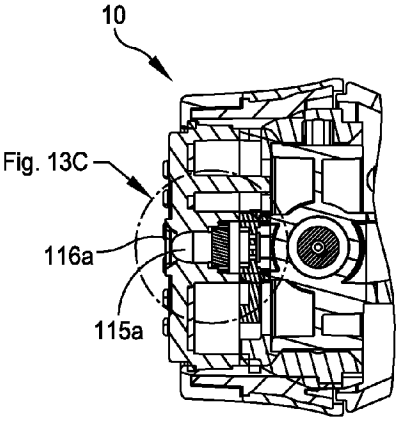
FIG. 13B is a partial longitudinal cross-sectional view of the spray head of FIG. 13 showing a side view of a jet sprayer.
Figure 13C:
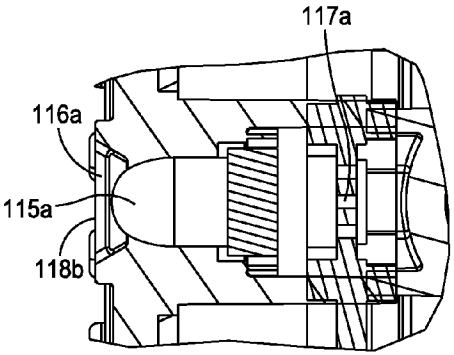
FIG. 13C is an enlarged side view of the jet sprayer of FIG. 13B.

Further, the nature and function of the jet sprayer may be formed with various configurations, including a venturi or other expanding and compressing configurations. A preferred sprayer for use in the embodiment 10 of the spray head of FIG. 1 is shown with reference to FIGS. 13-13F in a more detailed manner. The spray head 10 as shown has a misting sprayer and shower sprayer functions leading to misting sprayer outlet 61 and shower sprayer outlets 21 as mentioned above. The jet sprayer outlet 57 as shown in FIGS. 13E and 13D from the longitudinal center taken from a front view, has an opening path area 114*a* for receiving maximum flow into the area when the selector has moved to the jet sprayer function. A fitting directs flow through a smaller opening 117*a* to restrict flow that then expands in a larger curved jet head 115*a*. A divergent end fitting 118*b* as seen in FIG. 13F, then pushes jet spray in a broader direction after coming out of recessed outlet fitting 116*a*. The jet sprayer outlet 57 provides a powerful and sufficiently large jet spray from the outlet 57 for enhanced jet spraying and cleaning function.

The spray head 10 can also be fitted with a brush head attachment 104' as described further below having brush head body 109' as described below to be mounted over the faceplate 18*a* in the sprayer seat 18 by rotating locking fingers 105' described below in openings 102 provided in the faceplate 18*a*.

As shown in FIGS. 14-21, in a further embodiment herein, a spray head 110 is provided that is similar to embodiment 10 but has additional features, including at least one valve, for example, a valve controlled by a toggle and/or a pause and/or boost button that interrupts the flow path through the interior space 133 of the flow body 132 of spray head 110. Spray head 110 has a smooth outer shell 112 and a outer selector ring 128 having a selection ring 128*a* and a selector assembly seat 126. The upper end 150 of the shell 112 has a protruding end 152 of a flow body 132 with threads 154 thereon. The flow body 132, while extending through the spray head 110 from the top 150 thereof, has a different shape then flow body 132. The flow body 132 has an upper section 182*b* and a lower section 183. The upper section 182*b* and lower section 183 are joined by mounting screws 182*a* which connect the upper and lower sections of the flow body through extending mounting flanges 183*a*. The flow body 132 is interrupted part-way along the path in the upper portion to accommodate a pause function valve. Although a boost function valve may also be included in place of or in addition to a pause function valve as shown.

The valve 184 has an outer button 185 that when pushed depresses the first plunger 186 and the head 187 and valve stem 188 which has a tensile member 190 shown as a spring. The valve is sealed by one or more o-rings 139. As the button 185 is depressed, it closes off the standard regular spray head flow rate. If a boost valve were used, a similar configuration would be provided but depression of the button 185 would operate a slightly different valve to push a second valve section that would open a wider flow path below the check valve 136 into the spray head into area 191 to increase flow volume and rate into the interior of the spray head. This provides a boosted spray feature useful for faster filling of pots, buckets and the like. As shown, however, only a pause operation would occur in flow path through the interior 135. Also, as shown in FIG. 18, the valve is in the open position.

The toggle switch 192 with operable latch mechanism 193 operates a central flow path selection valve 194 that allows for selecting flow directly to the aerator 130 (using standard or boosted flow from valve 184 depending on if it is a pause or boost valve) in default mode or flow to the various sprayer functions (misting sprayer, shower sprayer and jet sprayer) when activated and selected. The toggle switch 192 engages and moves the head 195 of valve 194 which pushes the valve stem 196 back and forth opening and closing a direct flow path 197 to the aerator. The valve includes a tensile member 198, shown as a spring, for operable action.

Figure 14:
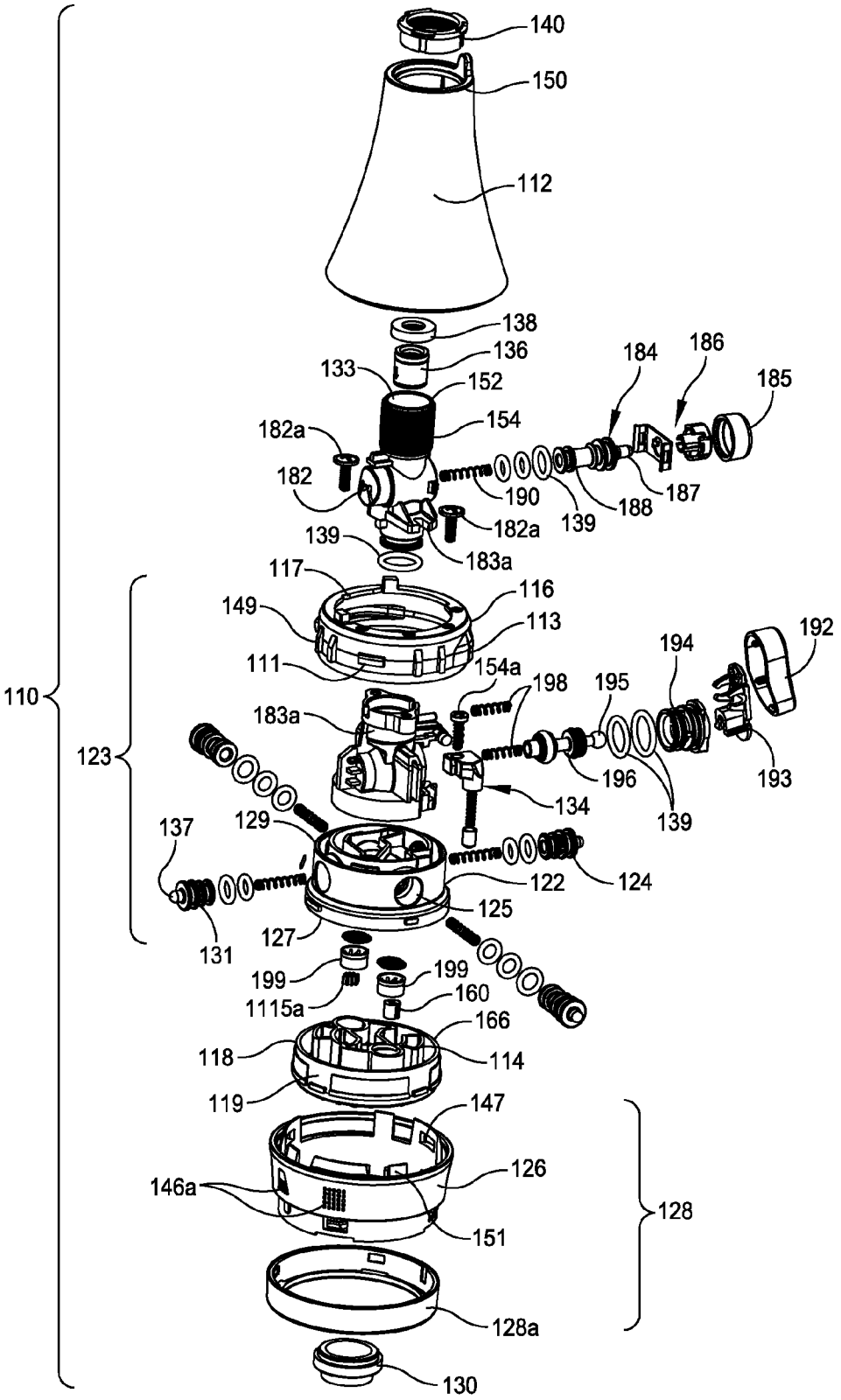
FIG. 14 is an exploded perspective view of a spray head having a selector toggle feature.
Figure 17:
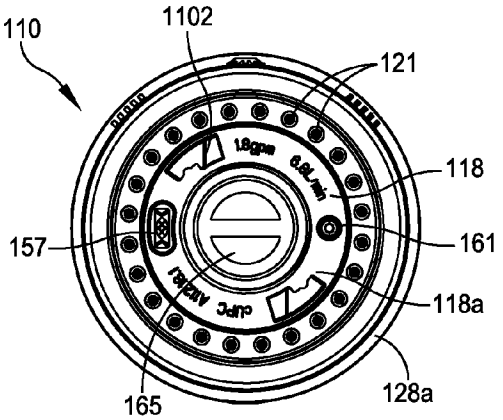
FIG. 17 is a bottom elevational view of the embodiment of FIG. 14.
Figure 16:
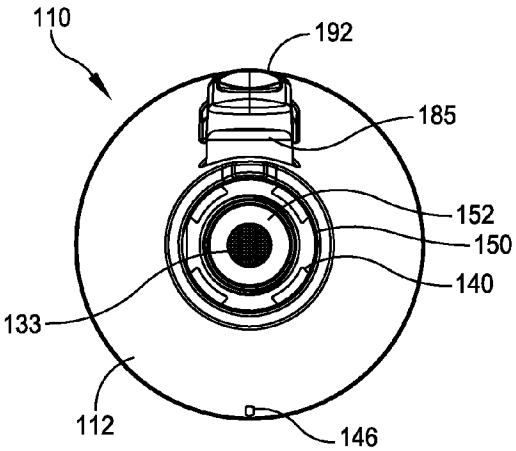
FIG. 16 is a top elevational view of the embodiment of FIG. 14.
Figure 15:
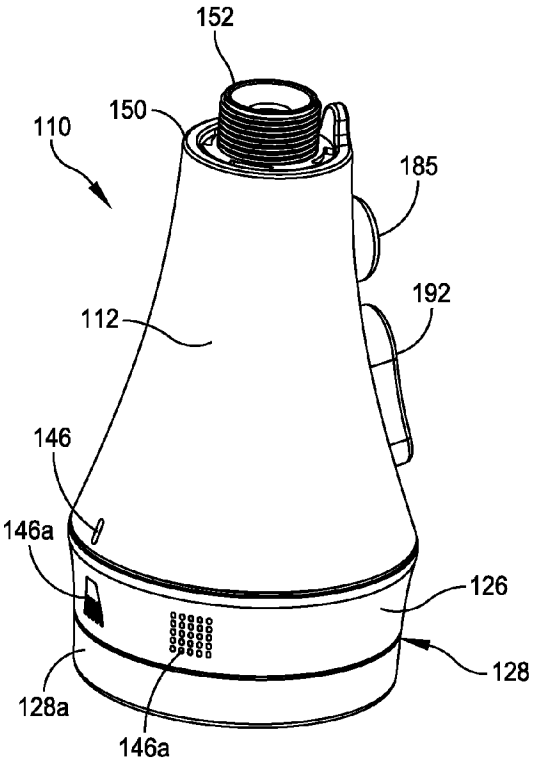
FIG. 15 is a perspective view of the spray head of FIG. 14.
Figure 17A:
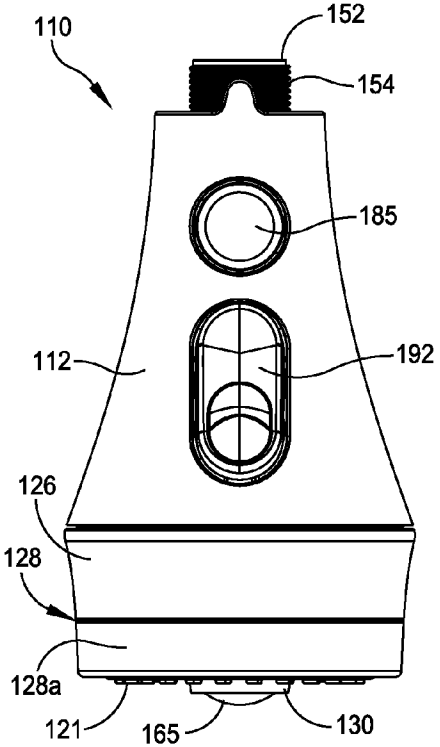
FIG. 17A is a front elevational view of the embodiment of FIG. 14.
Figure 17D:
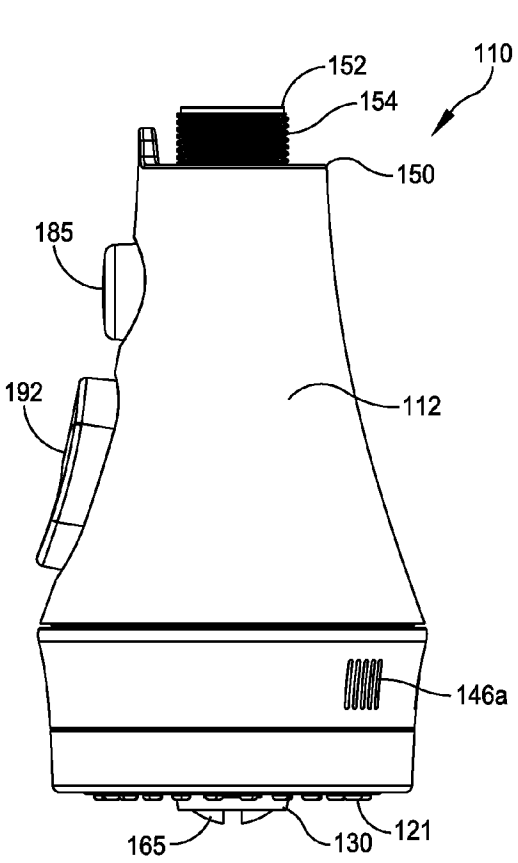
FIG. 17D is a further side elevational view showing another icon representing a tactile feature of the spray head of FIG. 14 for a functional feature different than that of FIG. 17C.
Figure 17B:
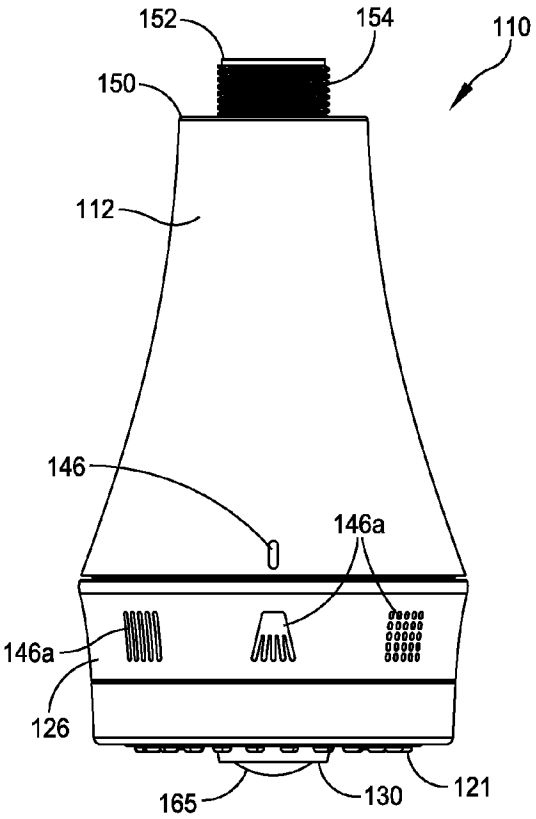
FIG. 17B is a further side elevational view showing three icons representing tactile features of the spray head of FIG. 14 corresponding to three functional features.
Figure 17C:
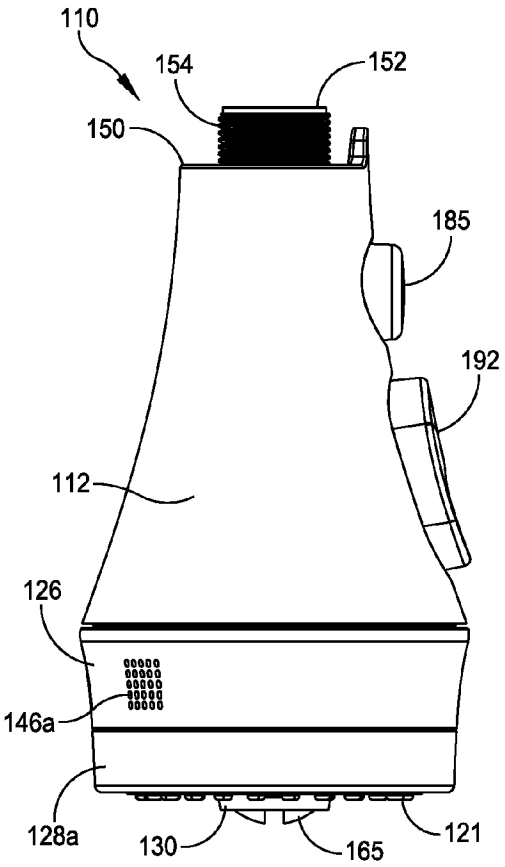
FIG. 17C is a side elevational view of the embodiment of FIG. 14 showing one of the icons representing a tactile feature of the spray head of FIG. 14 that corresponds to a functional feature.

When the toggle is in the spray selection mode, flow passes through the flow body 132 through the upper and lower halves of the flow body and after the valve 184 and the toggle valve body 194 in toggle valve 192 to the selector assembly 123. The assembly includes the rotating selector valve ring 116. With reference to FIG. 14, the selector assembly seat 126 has an upwardly extending portion 151 that fits inside the shell 112. The upwardly extending portion 151 engages exterior features 149 on rotating selector ring 116. Also, interlocking features 111 on the rotating selector ring 116 and features 147 on the selector seat 126 allow for these features to turn together. Thus, when the selection ring 128*a* and selector seat 126 of the selector ring 128 are turned, the inner rotating selector ring 116 also turns. It has features similar to those of the rotating selector ring of spray head 10 with respect to bump out features 113 that form interior recesses 143 from the inner configuration of the rotating selector ring 116.

Figure 18A:
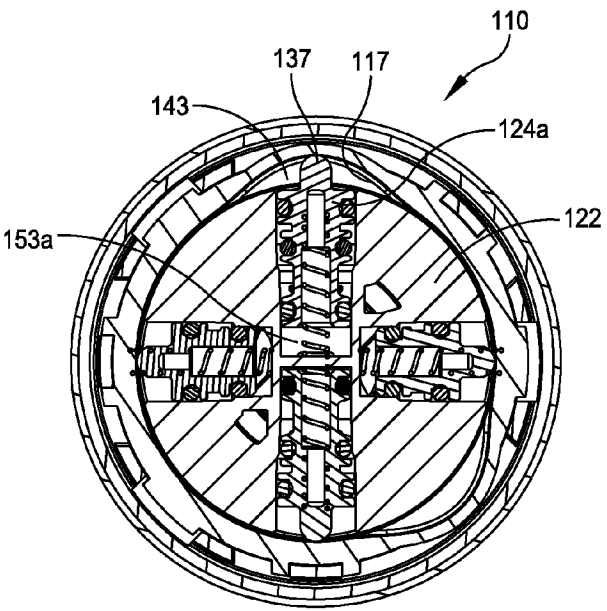
FIG. 18A is a transverse cross-sectional view of the spray head of FIG. 18 taken along line 18A-18A.
Figure 18:
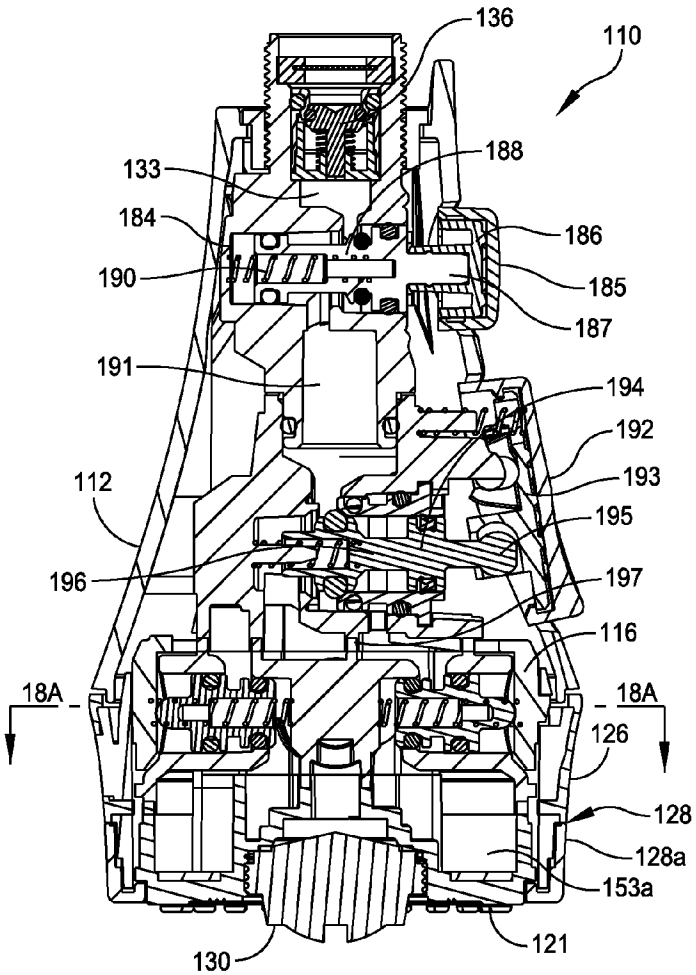
FIG. 18 is a longitudinal cross-sectional view of the spray head of FIG. 14 showing the toggle and pause buttons in the shower spray mode.
Figure 19:
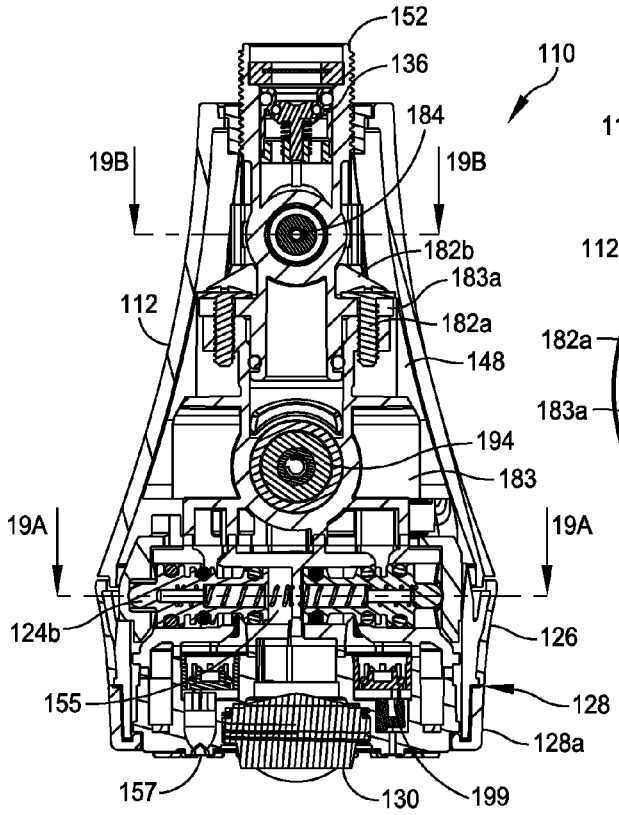
FIG. 19 is a longitudinal cross-sectional view of the spray head of FIG. 14 showing the toggle and pause buttons in the jet spray mode.
Figure 19B:
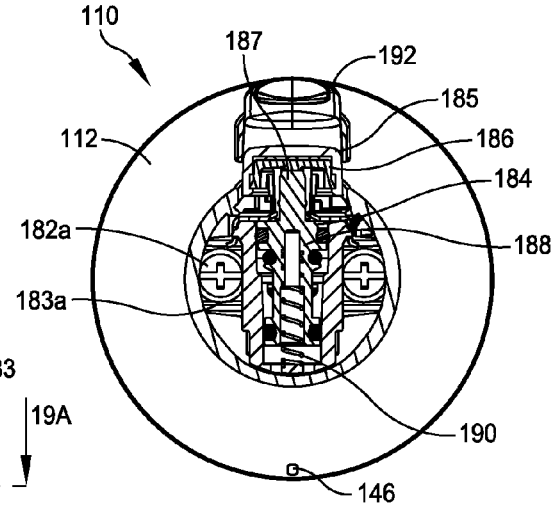
FIG. 19B is a transverse cross-sectional view of the spray head of FIG. 19 taken along line 19B-19B.
Figure 19A:
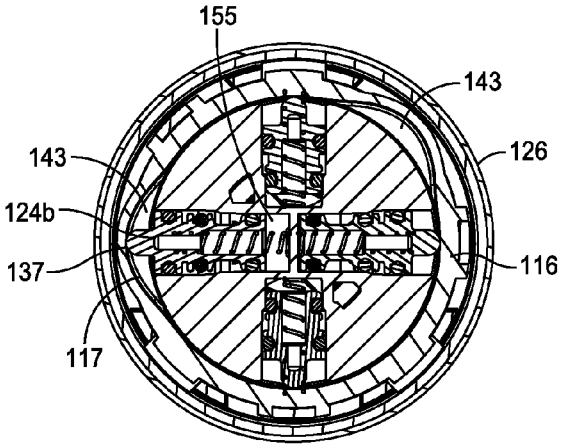
FIG. 19A is a transverse cross-sectional view of the spray head of FIG. 19 taken along line 19A-19A

As shown in FIG. 18, in one position, the toggle is set to allow flow through the open valve 194 to the selector valve housing 122 and to a selector valve 124*a* which is shown open and extending into a recess 143 opening a shower sprayer flow path 153*a* to the shower sprayer area 153 and to shower sprayer outlets 121. As shown in FIGS. 19-19B with the toggle still set to allow flow through the open valve 194 to the selector valve housing 122 and to a selector valve 124*b*, which is open, there is a space for flow to jet sprayer path 155 to jet spray exit 157.

Figure 21:
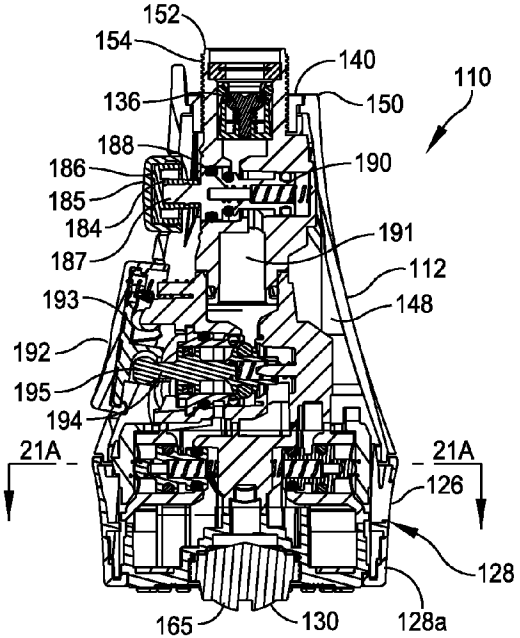
FIG. 21 is a longitudinal cross-sectional view of the spray head of FIG. 14 in the aerator mode.
Figure 21A:
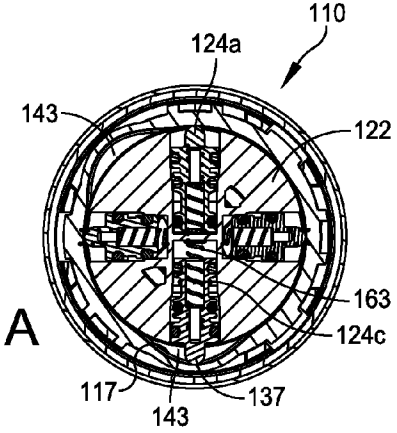
FIG. 21A is a transverse cross-sectional view of the spray head of FIG. 21 taken along line 21A-21A.
Figure 22:
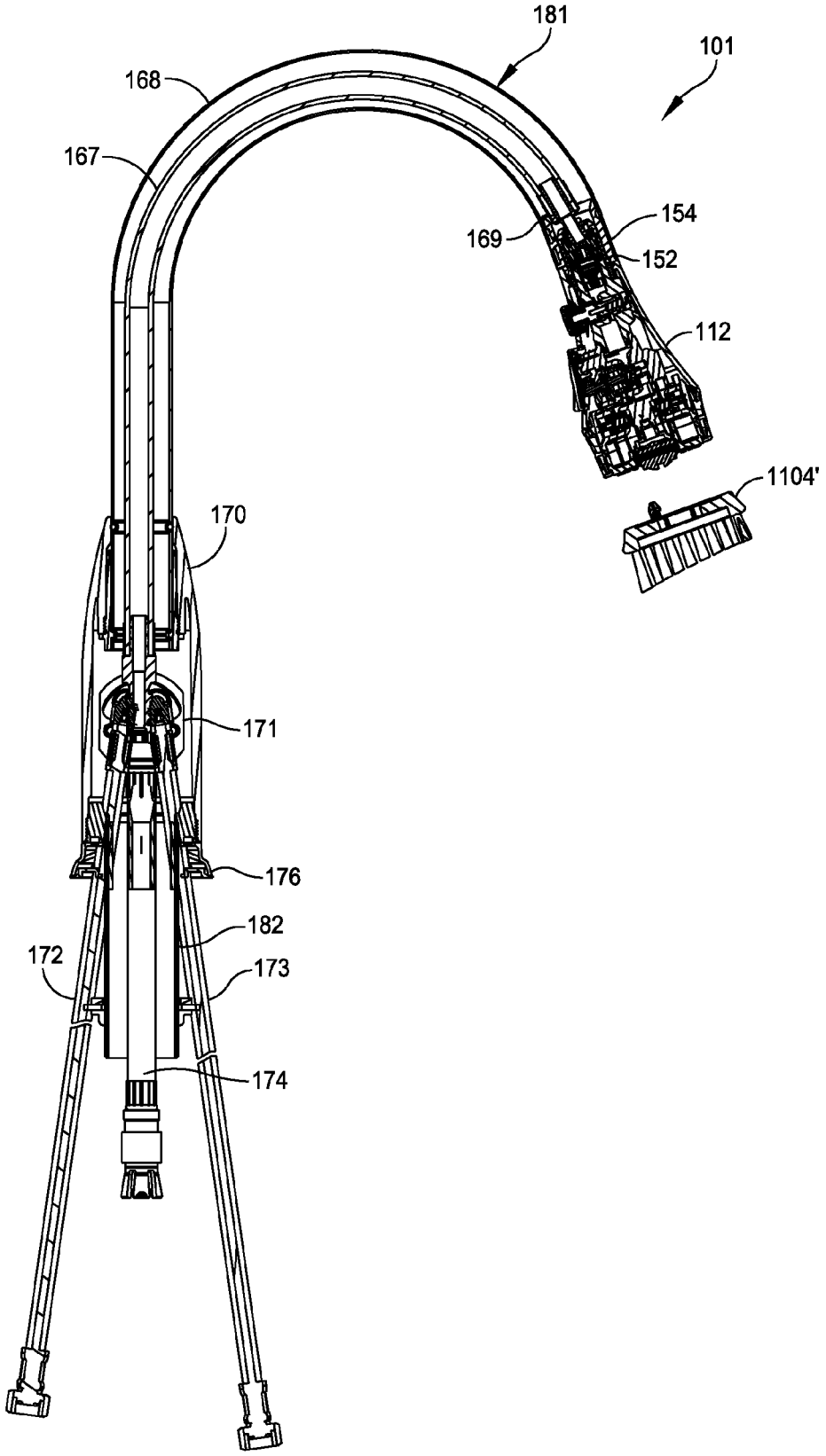
FIG. 22 is a longitudinal cross-sectional view of a kitchen faucet having a spray head according to the embodiment of FIG. 14 installed thereon with an optional brush feature.
Figure 23:
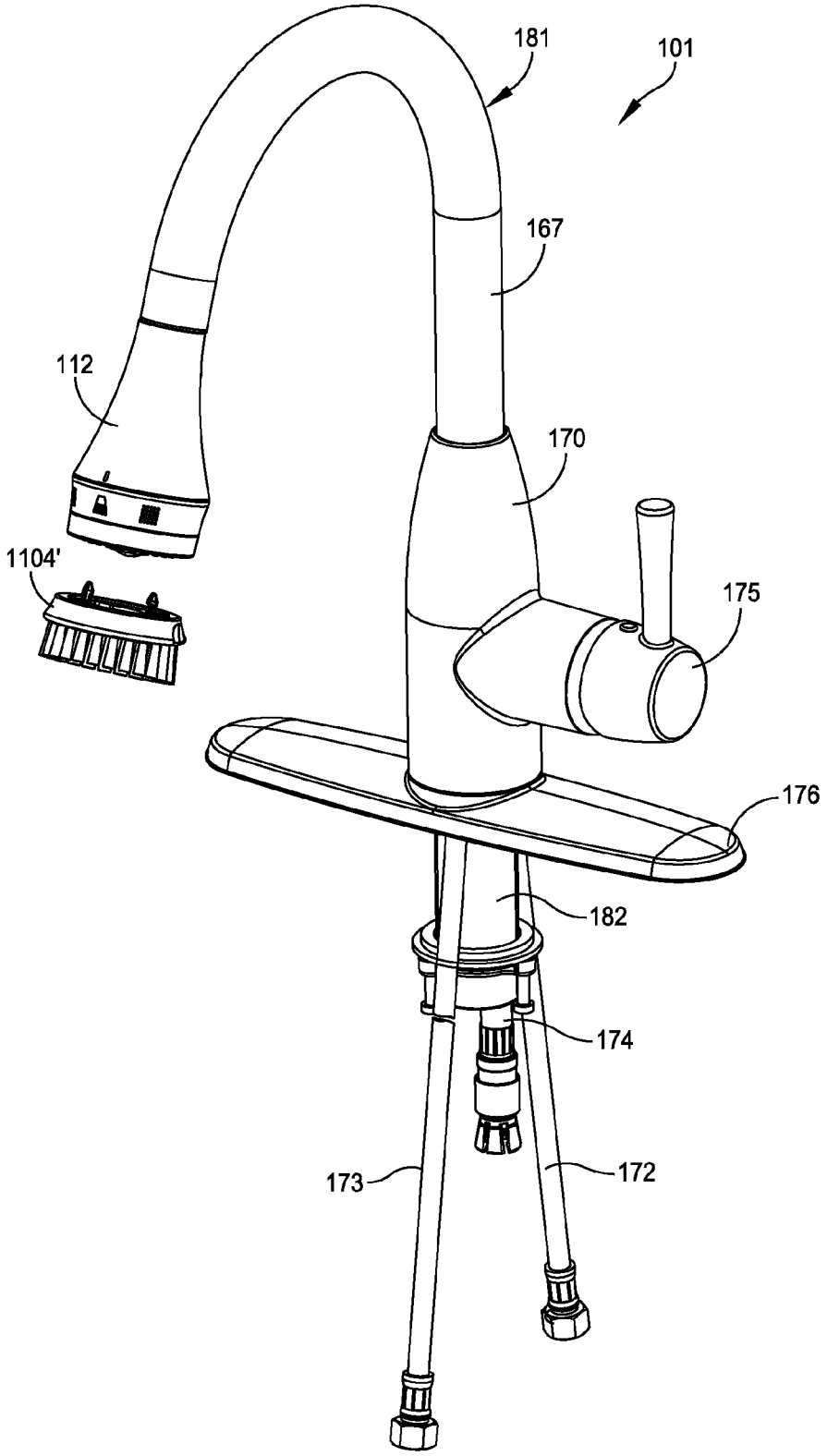
FIG. 23 is a perspective view of a kitchen faucet having the faucet spray head of FIG. 14 installed thereon of FIG. 22.
Figures 24, 24A:
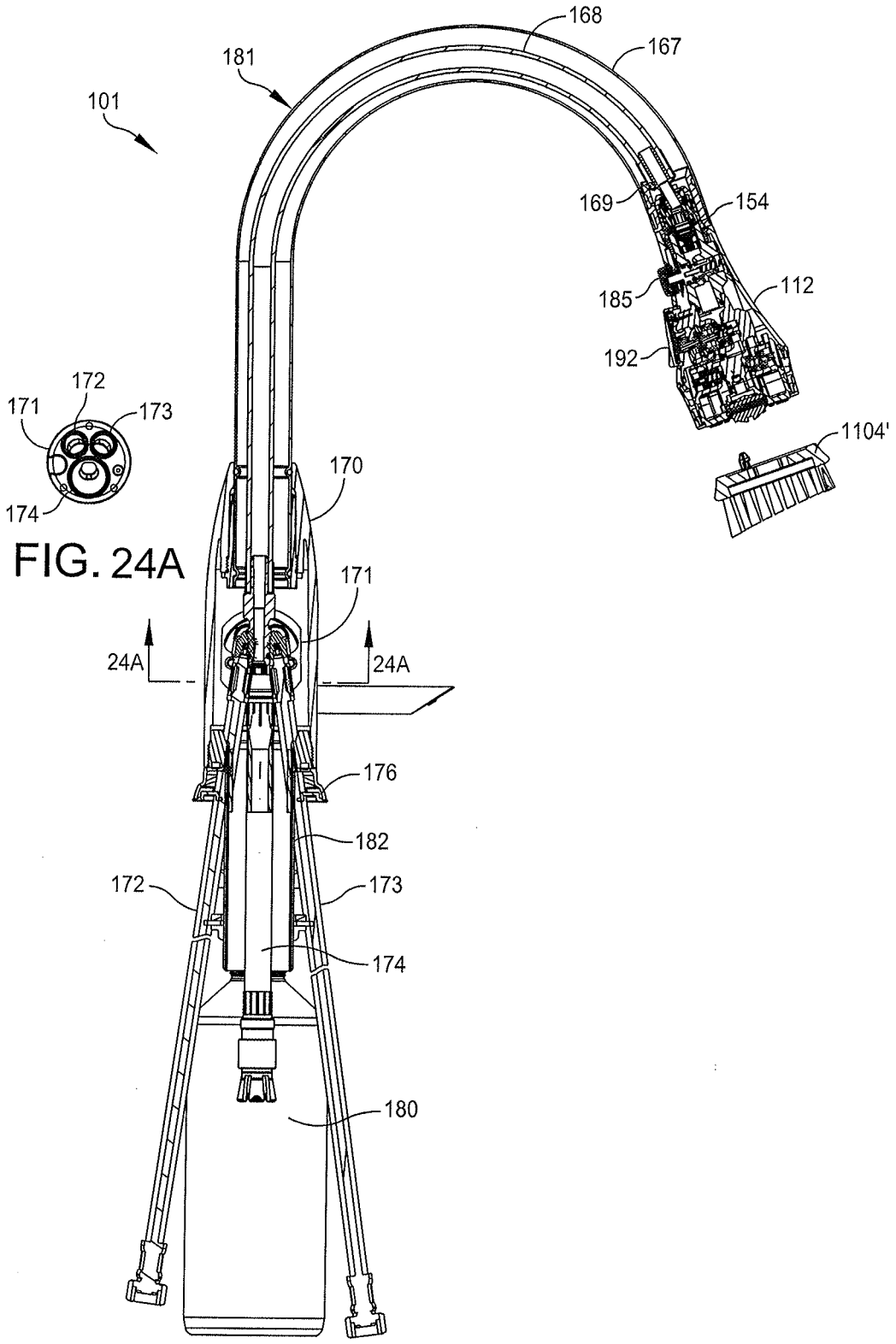
FIG. 24 is a longitudinal cross-sectional view of the kitchen faucet assembly having the spray head of FIG. 14, partly disassembled to show an optional brush feature and an optional soap dispenser feature.
FIG. 24A is a transverse cross-sectional view of the mixing valve of the faucet of FIG. 24 taken along line 24A-24A.

In FIG. 21, a flow path to the aerator function using the open toggle to the selector valve housing and through an open valve 124*c* extending into recess 143 to an aerator flow path 163. Alternatively the toggle 192 can be changed and the valve closed so as to open a direct path through a gap in the valve would be aligned with a flow path directly to the aerator. As shown, the valve is open and the aerator flow path 163 is through the selector valve housing 122 and valve 124*c*.

Figure 20:
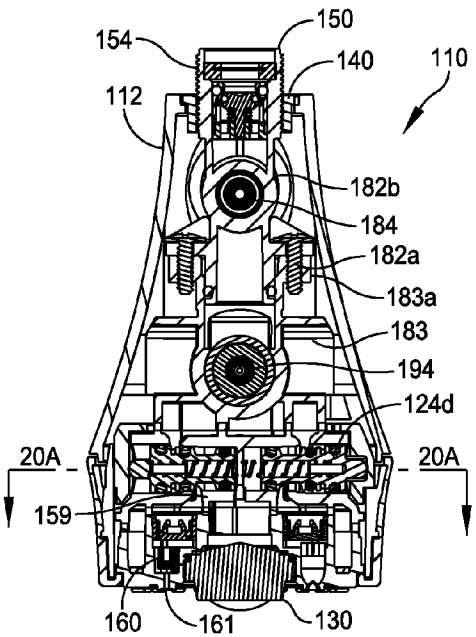
FIG. 20 is a longitudinal cross-sectional view of the spray head of FIG. 14 in the mist spray mode.
Figure 20A:
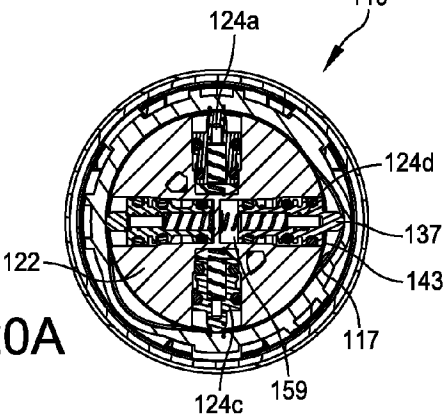
FIG. 20A is a transverse cross-sectional view of the spray head of FIG. 20 taken along line 20A-20A.

In FIG. 20, with the toggle valve in the open position as described previously, flow can pass to the selector valve housing 122 and through valve 124*d* by rotating ring 128 and inner selector ring 116 to chose a misting sprayer function. Flow then passes from the flow body in the lower portion after the toggle valve 192 to a misting flow path 159 through valve 124*d* to a misting sprayer outlet 161 (see FIGS. 20 and 20A).

The selector valve housing body 122 is situated within the interior of the rotating selector ring 116 and provides flow paths that are in fluid communication with corresponding flow diversion conduits 114 which may be molded as part of or ultrasonically welded within the sprayer seat 118 to directs flow from the valve housing body leaving a particular selected flow path due to valve selection if valve selection is selected by the toggle mechanism. Within particular conduits which flow to the misting spray head 160 and the jet spray head 157 can be inserted various stream directing and/or flow controlling devices, such as a baffle mechanism, flow expanded, flow rate controller or the like. As shown, stream directing devices 199 are provided to direct water in as streamlined a manner as possible into the misting head and jet spray head. An optional inserted spray selection or alignment disc may also be provided instead if desired.

Thus, while the spray head 110 works similarly to that of spray head 10, the lever switch or toggle button 192 in the middle portion of the spray body allows the flow to be switched between the selector valve body and multiple functions selected therein by rotating outer selector ring and a direct aerator spray. Similarly, by moving valve 190, and pushing button 185, flow can be completely interrupted with a pause button as shown, or expanded by use of a boost button either instead of or in addition to a pause button. A clicker or other tactile noise or sounds and can be used and felt from inside the water path and when using the outer selection ring which each serve as indicators to signal different mode selections or valve button or toggle use. The optional toggle switch provides the same tactile and auditory cues for alternating between aerated and various spray modes.

FIGS. 22-25 show an example of an embodiment of a faucet assembly 101 according the invention. The embodiment of the spray head 110 described above is shown with one type of faucet 181. The faucet 181 has a housing 167 which may be formed of any of the materials useful to form the outer shell 112 of the spray head 110 and may or may not be formed of the same material as the spray head. The housing 167 is within a supporting base 170 which receives the neck-like housing 167 on one end and encloses an interior hose 168 connected by a hose connection 169 which may be any such connection known or to be developed in the art. The end of the hose near the spray head, preferably has a mating ferrule nut housing interior threads in a standard manner to engage the threads 152 extending through the upper first end 151 of the spray head 110. The other end of the hose is configured to join in fluid communication with a mixed outlet hose 174 coming from a mixing valve 171 which receives flow of water from hot and cold water conduits 172, 173. Such valves are also known in the art and any such mixing valve may be used. The base 170 is situated in an escutcheon 176 and includes a lower mount portion 182 for mounting to a sink or counter. The mounting and sink features are not in and of themselves intended to be limiting and represent only a standard faucet assembly but for the incorporation of the unique spray head 110 herein. It is to be noted that faucet assembly 101 may also be fit so that the conduit introducing mixed water to the hose 168 can be configured so that the spray head is a pull out spray head as well for additional functionality and a magnet head fitting may be incorporated for stability once the spray head is seated in the faucet's neck-shaped housing 167.

Figure 25:
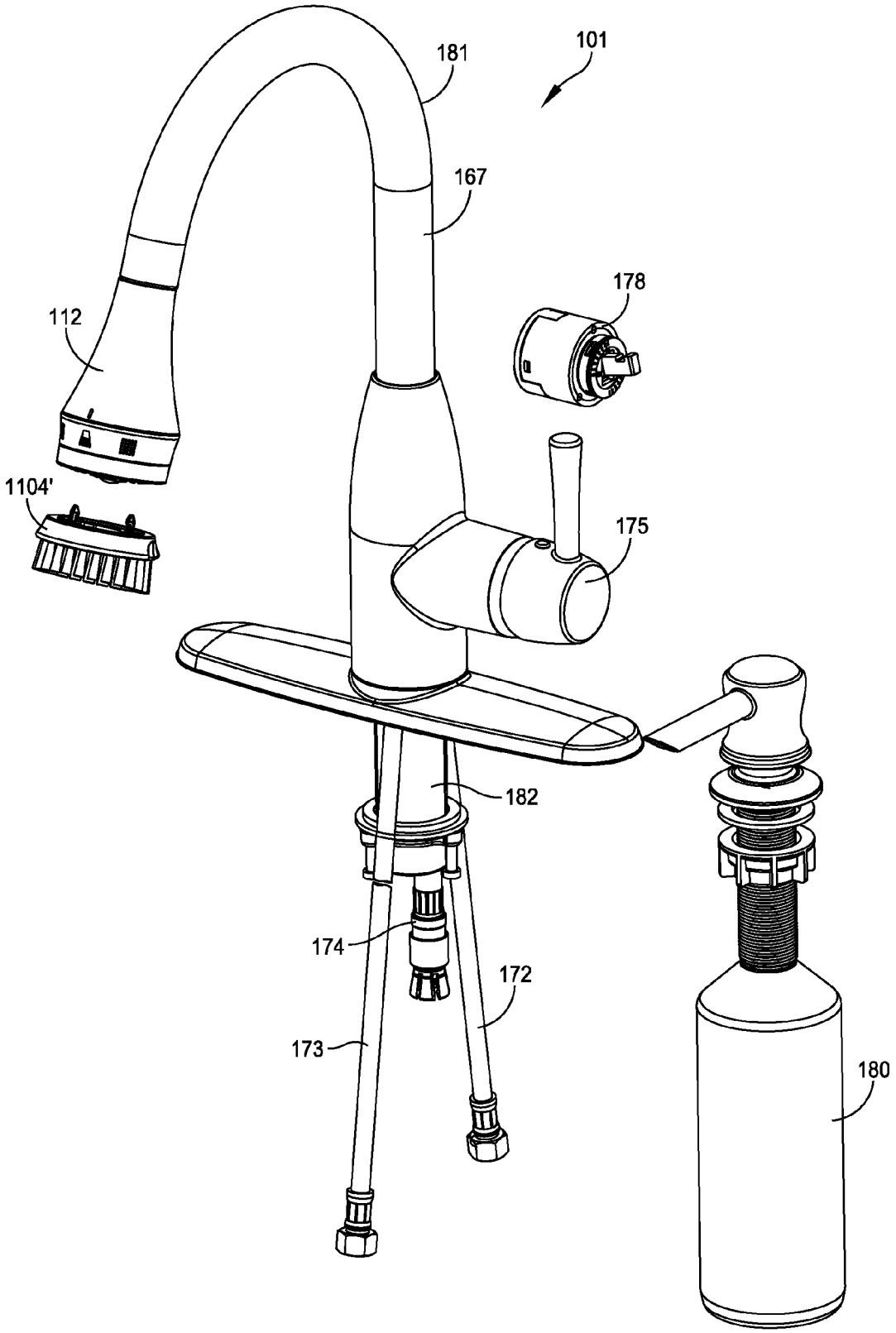
FIG. 25 is a perspective view of the kitchen faucet assembly of FIG. 24 having the faucet spray head of FIG. 14 installed thereon, partly disassembled to show the temperature and flow control valve inside the handle for introducing water at selected temperatures and flow volumes as well as an optional brush and soap dispenser feature.

The assembly 101 as shown in FIG. 25 may have a single rotatable hot/cold faucet valve 178 situated within the handle 175 for controlling hot and cold mixing in the mixing valve 171 depending on user preference. An optional soap dispenser 180 is also shown in the assembly in FIGS. 24-25, which can be mounted adjacent faucet 181 as an optional feature for assembly 101.

The spray head 110 can also be fitted with a brush head attachment 104' as described further below having brush head body 109' as described below to be mounted over the faceplate 118*a* in the sprayer seat 118 by rotating locking fingers 105' described below in openings 1102 provided in the faceplate 118*a*.

It should be understood, based on this disclosure, that other faucet assembly configurations and exterior designs as well as two-handle faucets, spread faucets not configured with an escutcheon, alternative mounting, mixing valves, handles, handle valves and valve bodies and other features may be modified and used with the novel spray head 110 herein within the scope of the invention.

Figure 26D:
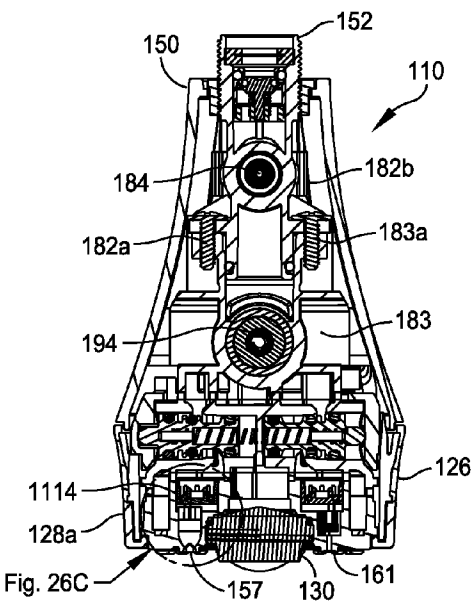
FIG. 26D is a longitudinal view of the spray head of FIG. 26 taken along line 26D-26D.
Figure 26E:
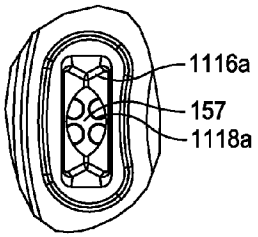
FIG. 26E is an enlarged bottom elevational view showing the jet sprayer.
Figure 26:
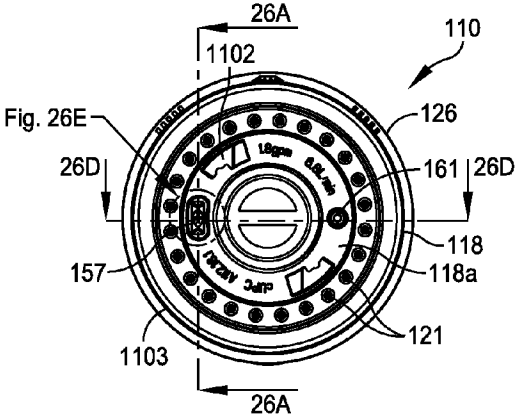
FIG. 26 is a bottom elevational view of the spray head of FIG. 14 having the faceplate thereon.
Figure 26C:
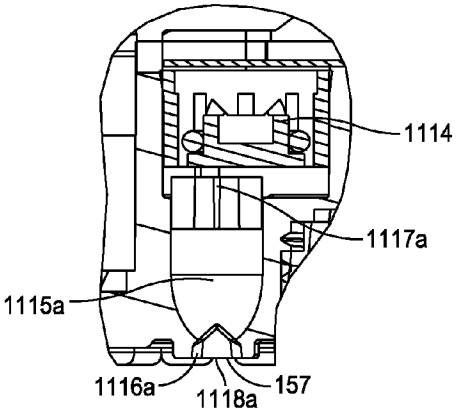
FIG. 26C is an enlarged view of the jet sprayer taken from the view of FIG. 26D.
Figure 26A:
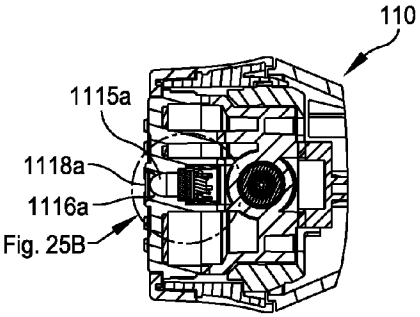
FIG. 26A is a partial longitudinal cross-sectional view of the spray head of FIG. 26 showing a side view of a jet sprayer taken along line 26A-26A.
Figure 26B:
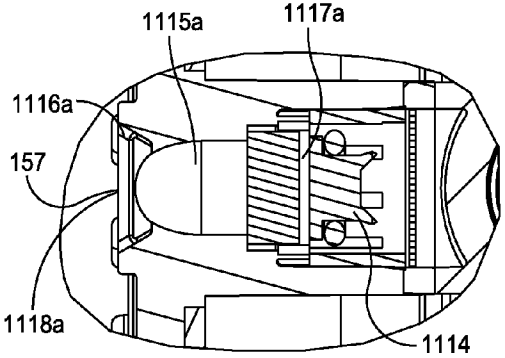
FIG. 26B is an enlarged side view of the jet sprayer of FIG. 26A.
Figure 28:
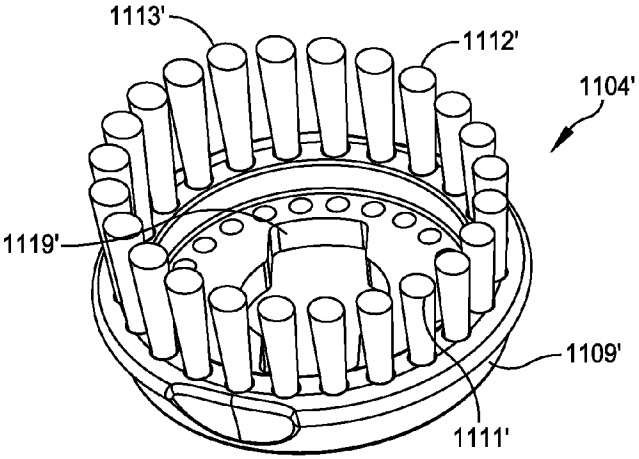
FIG. 28 is a bottom perspective view of the brush head attachment of FIG. 27.

Further, the nature and function of the jet sprayer may be formed with various configurations, including a venturi or other expanding and compressing configurations. A preferred sprayer for use in the embodiment 110 of the spray head of FIG. 14 is shown with reference to FIGS. 26-26E in a more detailed manner. The spray head 110 as shown has a misting sprayer and shower sprayer functions leading to misting sprayer outlet 161 and shower sprayer outlets 121 as mentioned above. The jet sprayer outlet 157 as shown in FIG. 26D from the longitudinal center taken from a front view, has a curved jet heat 1115*a* opening path area 1114*a* for receiving maximum flow into the area when the selector has moved to the jet sprayer function. A fitting directs flow through a smaller opening 1117*a* to restrict flow that then expands in a larger curved jet head 1115*a*. A divergent end fitting 1118*b* as seen in FIG. 26E, then pushes jet spray in a broader direction after coming out of recessed outlet fitting 1116*a*. The jet sprayer outlet 157 provides a powerful and sufficiently large jet spray from the outlet 157 for enhanced jet spraying and cleaning function.

The spray heads 10, 110 described above can each be fitted with a brush head attachment 104' having brush head body 109' to be mounted over the faceplate 18*a*, 118*a* in the sprayer seats 18, 118 by rotating locking fingers 105' described below in openings 102, 1102 provided in the faceplates 18*a*, 118*a* of spray heads 10, 110 to create a spray head and brush combination 110'. The optional feature of the brush head attachment for assemblies 10, 110 is described herein as an embodiment 110' which may incorporate either spray head 10, 110. FIGS. 39-42 show the brush head embodiment 110' using spray head 10, and FIGS. 35-38 show the brush head embodiment 110' using the spray head 110.

For convenience, the brush attachment embodiment 110' is described with respect to a spray head 110. As can be seen there are openings 1102 situated on the face plate 118*a* of spray head 110 at a distance from and between the jet sprayer outlet 157 and the misting sprayer outlet 161 and further at a location inwardly placed from shower sprayer outlets 121. The edge of the face plate on sprayer seat may be formed so as to have an extending circumferential flange 103 as shown in FIG. 13 recessed from the face plate 18*a* to create an area to receive an optional brush head attachment using a similar mating edge on the brush head upper surface. However, as shown, the brush head may also have a flush edge and lock only with the locking features that fit in openings 1102 which are configured to receive, for example, locking fingers 1105'. As can be seen in FIGS. 27-42, the brush attachment shaped to engage the face plate 18*a*, 118*a* of either sprayer seat 18, 118*a* so that it meets in facing engagement and locks either using the locking features (such as fingers 1105') or a circumferential flange such as flange 103 that can seat within a modified edge on the brush head.

Once locking fingers 1105' engage and lock into openings 1102 the spray head is rotatably locked into the brush head attachment 1104'. The brush head attachment 1104' remains stable in use, but can be manually removed by unlocking the locking fingers 1105' by rotating in the reverse direction of the locking direction.

Figure 30:
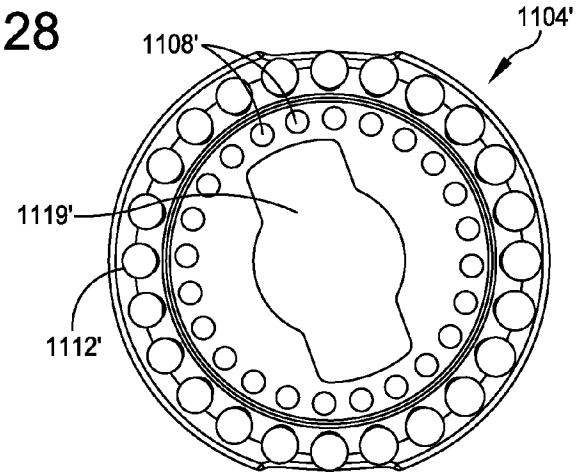
FIG. 30 is bottom plan view of the brush head attachment of FIG. 27.
Figure 27:
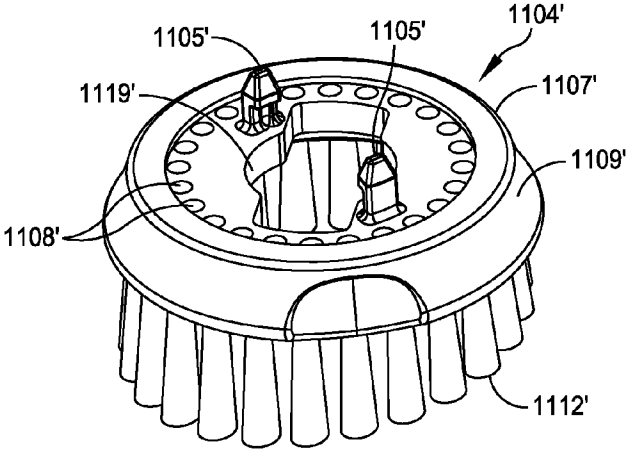
FIG. 27 is a top perspective view of a brush head attachment for attachment using the faceplate of FIG. 13 or 26.
Figure 29:
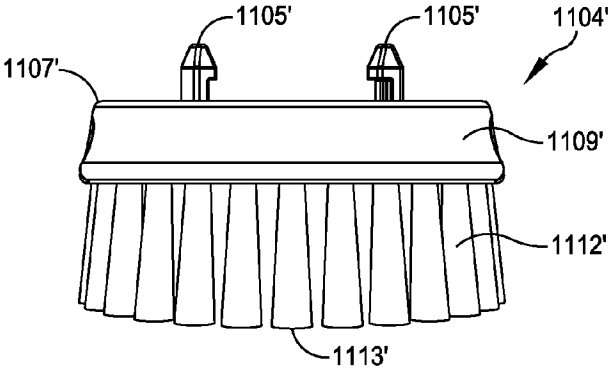
FIG. 29 is a side elevational view of the brush head attachment of FIG. 27 showing a long bristle side.
Figure 33:
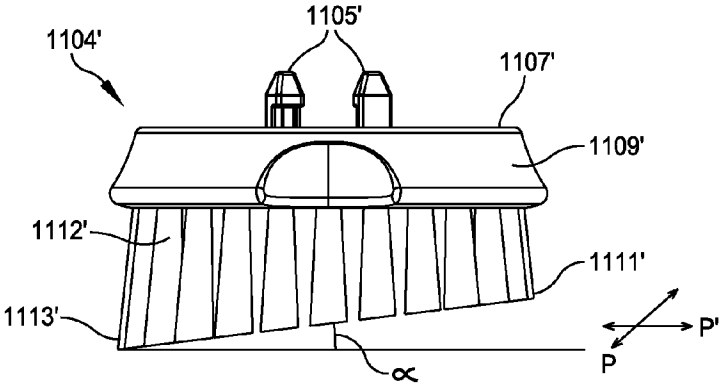
FIG. 33 is a side elevational view of the brush head attachment of FIG. 27 showing an incline angle for the bristles of the brush head attachment.
Figure 34:
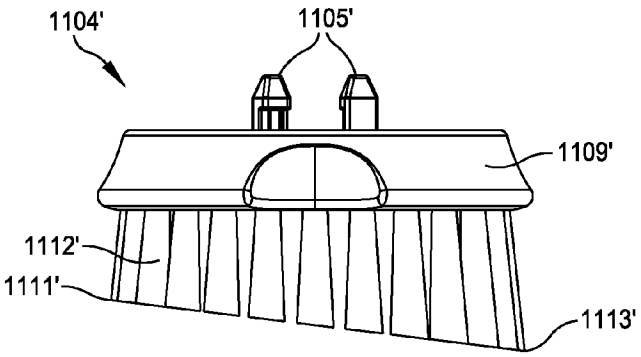
FIG. 34 is the opposite side elevational view of the brush head of FIG. 33.
Figure 32:
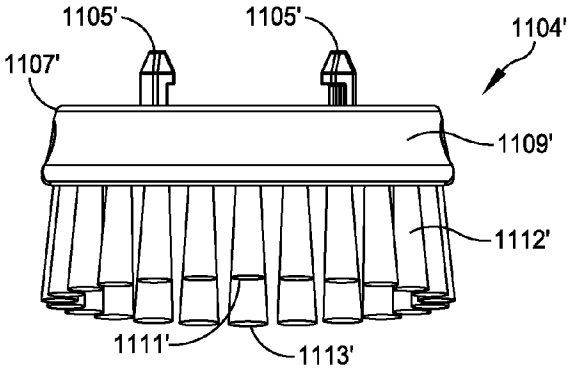
FIG. 32 is a further side elevational view of the brush head attachment of FIG. 27 on a short bristle side.
Figure 31:
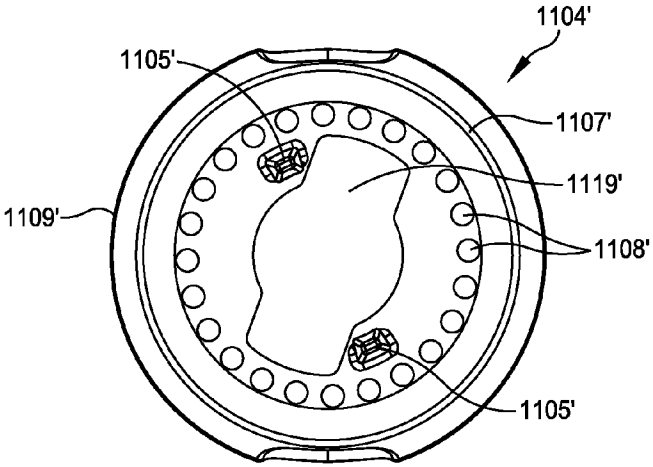
FIG. 31 is a top plan view of the brush head attachment of FIG. 27.
Figure 36:
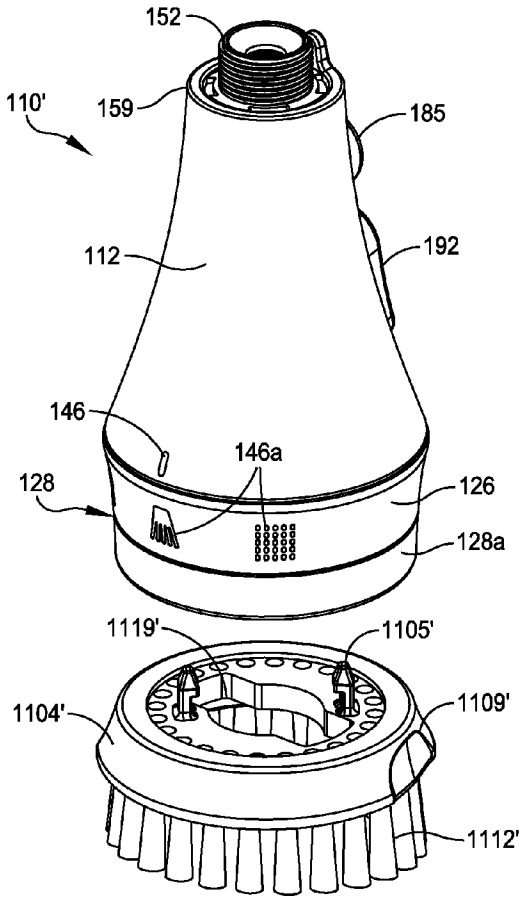
FIG. 36 is a disassembled view of the spray head and brush attachment of FIG. 35.
Figure 35:
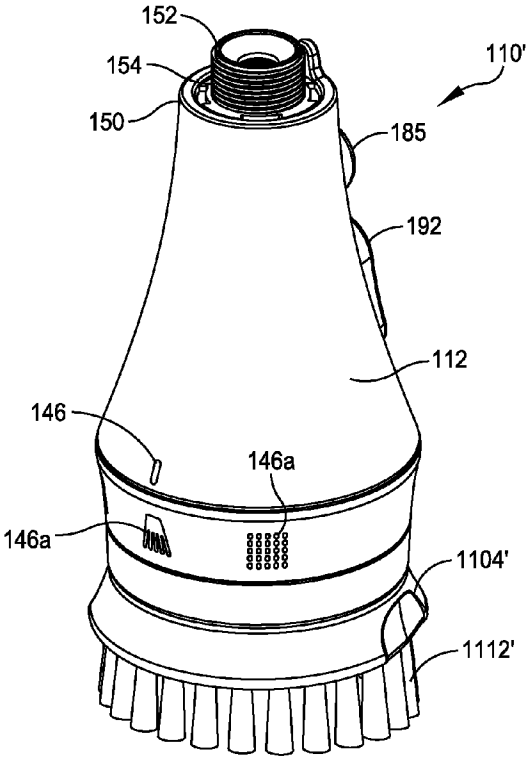
FIG. 35 is a perspective view of the spray head of FIG. 14 with the brush head of FIG. 27 installed thereon.
Figure 38:
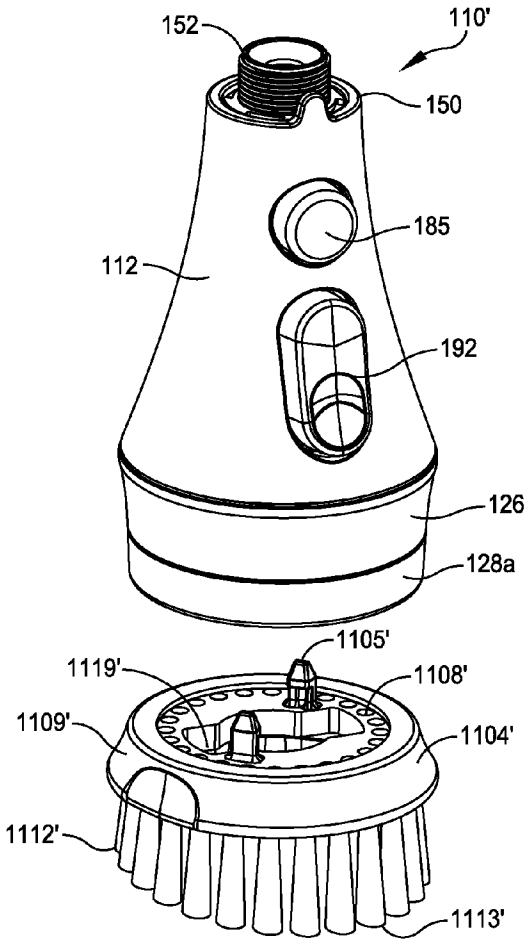
FIG. 38 is a disassembled view of the spray head and brush attachment of FIG. 37.
Figure 37:
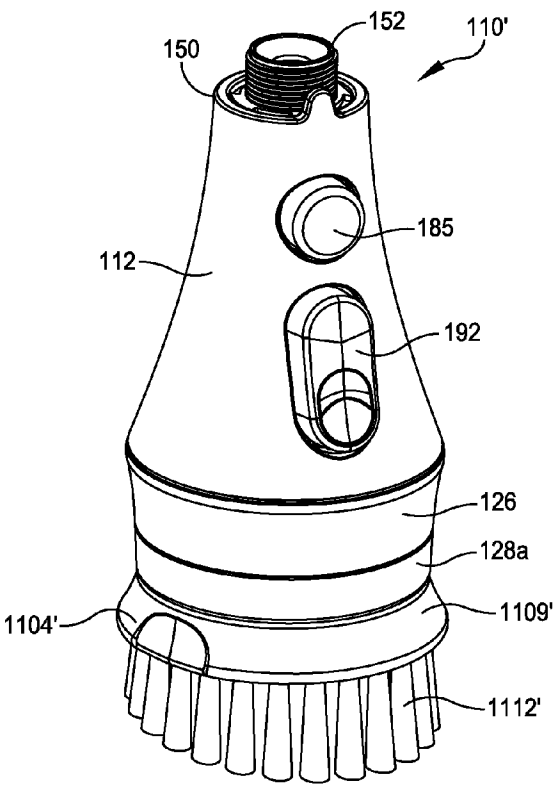
FIG. 37 is the spray head and brush attachment of FIG. 35 showing the toggle and pause buttons of the spray head of FIG. 14.
Figure 40:
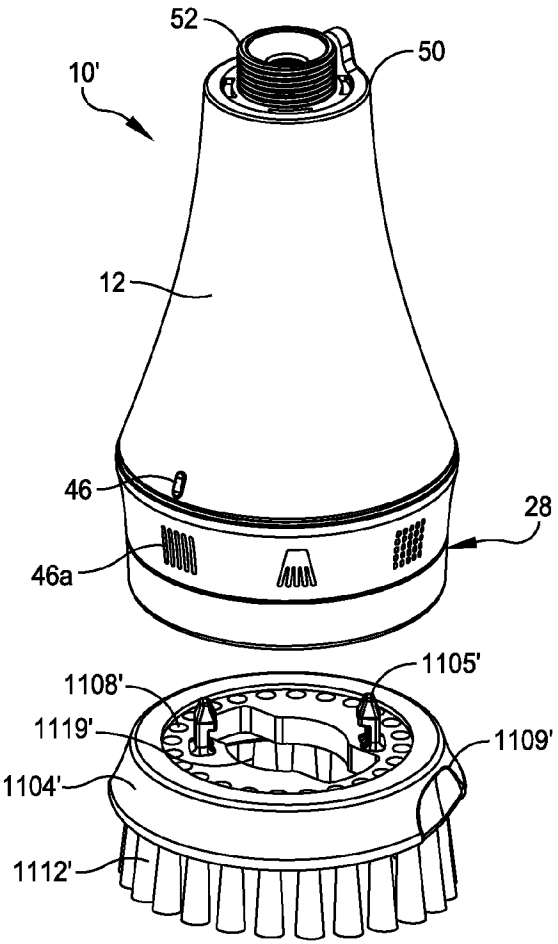
FIG. 40 is a disassembled view of the spray head and brush attachment of FIG. 39.
Figure 39:
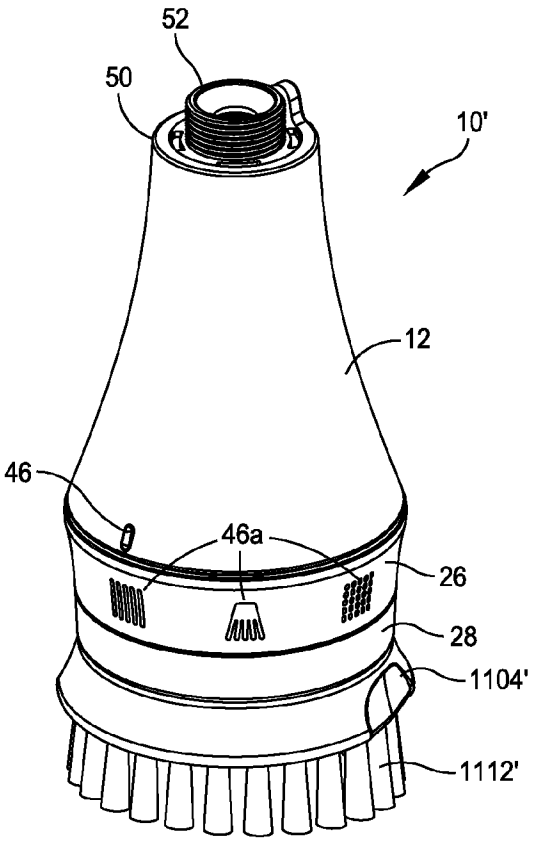
FIG. 39 is a perspective view of the spray head of FIG. 1 with the brush head of FIG. 27 installed thereon.
Figure 42:
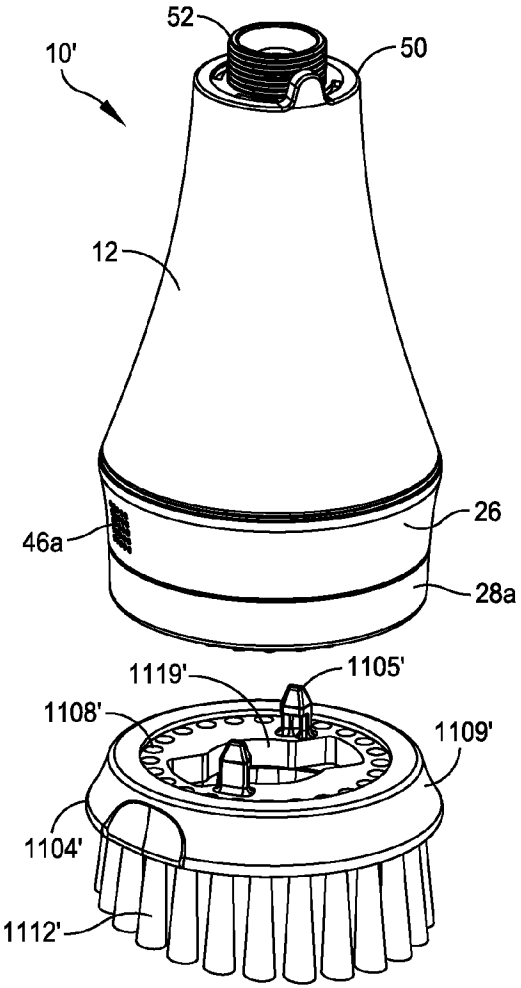
FIG. 42 is a disassembled view of the spray head and brush attachment of FIG. 41.
Figure 41:
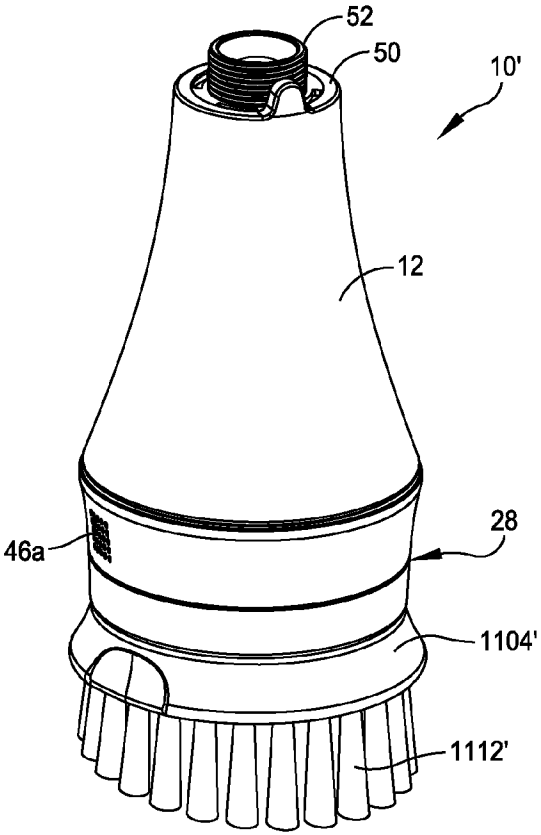
FIG. 41 is a spray head and brush attachment of FIG. 39 showing a different view.

The further upper edge 1107' is provided to fit into or substantially flush with the faceplate and has an opening 1119' open to the aerator 130 so that flow may pass through the brush attachment 1114' when in normal aerator use or a selected aerator mode. FIGS. 27, 30 and 31 show that on the top of the brush head attachment 1104' there are openings

1108' formed through the body 1109' of the brush head attachment 1104' to align with shower sprayer outlets 121 so that while using the spray head attachment, spray flow may leave the spray head and pass through the brush head attachment 1104' for use in cleaning. Similarly the opening 1119' is large enough to extend outwardly on opposite sides from the aerator to receive and allow flow from a jet sprayer outlet 157 and a misting sprayer outlet 161 respectively when either of those spray functions is in use.

The brush head attachment 1104' as shown has an outer ring of brush bristles 1112'. As shown the bristles 1112' are of varying heights and arranged so as to be angled at an angle α with respect to a transverse plane P-P' taken through the end of the longest bristle (when viewed in side view as in FIGS. 33-34) from a high end 1113' to a low end 1111' for cleaning action, however, the bristles may be of the same height, varying or uneven heights, varying textures, shapes and scrubbing action to provide varied brush head attachments for different cleaning action or preference. Preferably the bristles are formed of a polymeric material for easy manufacture and good wear, and can also be made so as to be mold- or germ-resistant if desired.

The various embodiments herein with enhanced spray function increase clean up time using the jet spray function to hasten cleaning time. Cleaning can be further enhanced using the brush spray attachments described herein. Further use of a boosting function if employed as an interruptive valve if used with a button actuator such as button 185 in certain embodiments can also increase flow rate from about 0.66 gpm to about 1.4 gpm so that standard aerated flow becomes a useful fast pot or bucket filling feature as well as provides the ability to enhance the speed and force of the sprayer functions if so desired by also actuating the boost button while the spray head is in one of the three sprayer modes.

It should also be understood that while four spray functions (shower sprayer, aerated flow, misting sprayer and jet sprayer) are described in the preferred embodiments described herein, it is within the scope of the invention to change or add further spray functions if desired by modifying outlets and/or adding additional valves, selector switches and/or further paths and openings in a selector disc, divider or alternate flow diversion conduits within the shell of the faucet sprayer heads described herein.

It is also possible to create lavatory or industrial faucets having spray heads as described herein even through the preferred embodiment was exemplified with respect to a kitchen faucet. It should also be understood that the various interior parts of the shell may be formed of polymeric molding materials or composites as described with respect to the shell and brush head attachments, and that the brush head attachments may be varied for different cleaning functions.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A faucet assembly having a multifunction spray head, wherein the spray head is capable of providing an aerated spray and at least one spray function, comprising an outer shell;

a flow body extending within the shell, having a first end extending out of the shell for attachment to a faucet and a second end in fluid communication with a spray selector assembly, wherein the flow body defines a flow path from the first end of the flow body to a flow selector assembly;

the flow selector assembly comprising:

a selector valve housing body having at least two valve recesses therein;

at least two flow selector valves seated within the recesses in the selector valve housing body; and a rotating selector valve ring capable of rotating around the selector valve housing body to open a selector valve and close the at least one other selector valve for opening a flow path through the flow selector assembly when each selector valve is open;

a sprayer seat having a faceplate thereon and having one or more flow diversion conduits aligned with each valve in the selector valve housing body for providing fluid communication from each flow path leaving a selector valve to a sprayer outlet at the end of a flow path through the flow selector assembly or to an aerator outlet at the end of a flow path through the flow selector assembly; and an outer selector ring comprising a selector assembly seat for seating the flow selector assembly and the sprayer seat and engaging the rotating selector valve ring; and wherein the flow body provides a flow path through the flow body and the selector valves provide selected flow paths sufficient to provide at least an aerator flow path to an aerator outlet, and at least one flow path to alternate spray function outlet, wherein rotation of the outer selector ring engages the selector assembly seat and the rotating selector valve ring to change the at least one spray function.

2. The faucet assembly according to claim 1, wherein the at least one spray function is selected from a shower sprayer, a misting sprayer, and a jet sprayer.

3. The faucet assembly according to claim 2, wherein the faucet is a kitchen faucet.

4. The faucet assembly according to claim 1, wherein there are at least three spray functions in addition to an aerator flow function.

5. The faucet assembly according to claim 4, wherein the at least three spray functions comprise a shower spray, a misting spray and a jet spray.

6. The faucet assembly according to claim 5, wherein the faucet assembly has at least four flow selector valves seated within at least four of the recesses in the selector housing body for providing four flow paths, comprising an aerator path to an aerator outlet, a shower sprayer path to at least one shower sprayer outlet, a misting sprayer path to a misting sprayer outlet and a jet sprayer path to a jet sprayer outlet.

7. The faucet assembly according to claim 6, wherein flow from the selector housing body flow selector valves passes through a corresponding flow diversion conduit for directing flow to the aerator and sprayer outlets.

8. The faucet assembly according to claim 1, wherein the faucet is a kitchen faucet.

9. The faucet assembly according to claim 1, wherein the flow path of the flow body is interrupted by at least one valve.

10. The faucet assembly according to claim 9, wherein the at least one valve interrupting the flow path is a boost valve for increase flow rate.

11. The faucet assembly according to claim 9, wherein the at least one valve interrupting the flow path is a pause valve.

12. The faucet assembly according to claim 9, wherein the at least one valve is a valve for switching between an aerator flow path and a flow path to the flow selector assembly for selecting one or more sprayer functions.

13. The faucet assembly according to claim 1, wherein there are four flow selector valves.

14. The faucet assembly according to claim 1, wherein each of the at least one flow selector valve has a valve head, a valve stem and a tensile member and wherein the valve head is capable of being depressed by the rotating selector valve ring or being expanded in a recess within the rotating selector valve ring.

15. The faucet assembly according to claim 1, wherein the face plate is configured to receive a brush head attachment.

16. The faucet assembly according to claim 1, comprising a boost function to enhance water flow for filling pots.

17. A faucet assembly according to claim 1, comprising a toggle switch for changing between aerated spray and one or more spray functions.

18. The faucet assembly according to claim 1, wherein the outer selector ring has one or more tactile features for selecting a spray function.

19. The faucet assembly according to claim 1, wherein the outer selector ring has one or more icons, each for identifying a corresponding spray function.

20. The faucet assembly according to claim 1, wherein the jet sprayer function comprises a curved jet head and a divergent spray outlet recessed in the spray head.

21. The faucet assembly according to claim 1, wherein the spray head connects to a pull-out sprayer hose within a faucet housing.

22. The faucet assembly according to claim 1, comprising a mixing valve and a handle with a flow adjustment valve therein.

23. A multifunction spray head for a faucet, wherein the spray head is capable of an aerated spray and at least one spray function, comprising an outer shell;

a flow body extending within the shell, having a first end extending out of the shell for attachment to a faucet and a second end in fluid communication with a spray selector assembly, wherein the flow body defines a flow path from the first end of the flow body to a flow selector assembly;

the flow selector assembly comprising:

a selector valve housing body having at least two valve recesses therein;

at least two flow selector valves seated within the recesses in the selector valve housing body; and a rotating selector valve ring capable of rotating around the selector valve housing body to open a selector valve and close the at least one other selector valve for opening a flow path through the flow selector assembly when each selector valve is open;

a sprayer seat having a faceplate thereon and having one or more flow diversion conduits aligned with each valve in the selector valve housing body for providing fluid communication from each flow path leaving a selector valve to a sprayer outlet at the end of a flow path through the flow selector assembly or to an aerator outlet at the end of a flow path through the flow selector assembly; and an outer selector ring comprising a selector assembly seat for seating the flow selector assembly and the sprayer seat and engaging the rotating selector valve ring; and wherein the flow body provides a flow path through the flow body and the selector valves provide selected flow paths sufficient to provide at least an aerator flow path to an aerator outlet, and at least one flow path to alternate spray function outlet, wherein rotation of the outer selector ring engages the selector assembly seat and the rotating selector valve ring to change the at least one spray function.

24. The multifunction spray head for a faucet according to claim 23, wherein the faucet is a kitchen faucet.

25. The multifunction spray head for a faucet according to claim 24, wherein the at least one spray function is selected from an aerated spray, a shower spray, a misting spray, and a jet spray.

26. The multifunction spray path according to claim 23, wherein there are four selector valves in four recesses within the selector valve housing body to provide an aerator flow path to an aerator outlet, at least one shower sprayer path to at least one shower sprayer outlet, a misting sprayer path to a misting sprayer outlet and a jet sprayer path to a jet sprayer outlet.

27. The multifunction spray head for a faucet according to claim 23, wherein the flow path of the flow body is interrupted by at least one valve.

28. The multifunction spray head for a faucet according to claim 27, wherein the at least one valve interrupting the flow path is a boost valve for increase flow rate.

29. The multifunction spray head for a faucet according to claim 27, wherein the at least one valve interrupting the flow path is a pause valve.

30. The multifunction spray head for a faucet according to claim 27, wherein the at least one valve is a valve for switching between an aerator flow path and a flow path to the flow selector assembly for selecting one or more other sprayer functions.

31. The multifunction spray head for a faucet according to claim 23, wherein each of the at least two flow selector valves has a valve head, a valve stem and a tensile member and wherein the valve head is capable of being depressed by the rotating selector valve ring or being expanded in a recess within the rotating selector valve ring.

32. The multifunction spray head for a faucet according to claim 23, wherein the face plate is configured to receive a brush head attachment.

33. The multifunction spray head for a faucet according to claim 23, wherein the outer selector ring has one or more tactile features for selecting a spray function.

34. The multifunction spray head for a faucet according to claim 23, wherein the outer selector ring has one or more icons, each identifying a corresponding spray function.

35. The multifunction spray head for a faucet according to claim 23, wherein the jet sprayer function comprises a curved jet head and a divergent spray outlet recessed in the spray head.

36. The multifunction spray head according to claim 23, wherein the outer selector ring comprises a rotating selection ring mounted on and the selector assembly seat that rotates with the selector assembly seat when turning the outer selector ring.

37. A multifunction spray head for a faucet, wherein the spray head is capable of an aerated spray and at least one spray function, comprising an outer shell;

a flow body extending within the shell, having a first end extending out of the shell for attachment to a faucet and a second end in fluid communication with a spray selector assembly, wherein the flow body defines a flow path from the first end of the flow body to a flow selector assembly;

the flow selector assembly comprising:

a selector valve housing body having at least two valve recesses therein;

at least two flow selector valves seated within the recesses in the selector valve housing body; and a rotating selector valve ring capable of rotating around the selector valve housing body to open a selector valve and close the at least one other selector valve for opening a flow path through the flow selector assembly;

a sprayer seat having a faceplate thereon and comprising flow diversion conduits for receiving flow from each selector valve when open; and an outer selector ring, comprising a selector assembly seat for seating the flow selector assembly and engaging the rotating selector valve ring; and wherein the flow body provides a flow path through the flow body and the selector valves provide selected flow paths sufficient to provide at least two flow paths to at least two flow outlets, wherein rotation of the outer selector ring engages the selector assembly seat and the rotating selector valve ring to change at least one spray function, and wherein the flow path of the flow body is interrupted by a valve for switching between the aerator flow path and a flow path to the flow selector assembly for selecting one or more other sprayer functions.

38. The multifunction spray head for a faucet according to claim 37, wherein the face plate is configured to receive a brush head attachment.

39. The multifunction spray head for a faucet according to claim 37, wherein the outer selector ring has one or more tactile features for selecting a spray function.

40. The multifunction spray head for a faucet according to claim 37, wherein the outer selector ring has one or more icons, each identifying a corresponding spray function.

41. The multifunction spray head for a faucet according to claim 37, wherein the jet sprayer function comprises a curved jet head and a divergent spray outlet recessed in the spray head.

42. A multifunction spray head for a faucet, wherein the spray head is capable of an aerated spray and at least one spray function, comprising an outer shell;

a flow body extending within the shell, having a first end extending out of the shell for attachment to a faucet and a second end in fluid communication with a spray selector assembly, wherein the flow body defines a flow path from the first end of the flow body to a flow selector assembly;

the flow selector assembly comprising:

a selector valve housing body having at least two valve recesses therein;

at least two flow selector valves seated within the recesses in the selector valve housing body; and a rotating selector valve ring capable of rotating around the selector valve housing body to open a selector valve and close the at least one other selector valve for opening a flow path through the flow selector assembly;

a sprayer seat having a faceplate thereon and comprising a corresponding flow diversion conduit for each selector valve; and an outer selector ring comprising a selector assembly seat for seating the flow selector assembly and engaging the rotating selector valve ring, wherein the flow body provides a flow path through the flow body and the selector valves provide selected flow paths sufficient to provide at least two flow paths to at least two flow outlets and wherein rotation of the outer selector ring engages the selector assembly seat and the rotating selector valve ring to change at least one spray function, and wherein the outer selector ring has one or more icons, each identifying a corresponding spray function.

43. The multifunction spray path according to claim 42, wherein there are four selector valves in four recesses within the selector valve housing body to provide an aerator flow path to an aerator outlet, at least one shower sprayer path to at least one shower sprayer outlet, a misting sprayer path to a misting sprayer outlet and a jet sprayer path to a jet sprayer outlet.

44. The multifunction spray head for a faucet according to claim 42, wherein the flow path of the flow body is interrupted by at least one valve.

45. The multifunction spray head for a faucet according to claim 44, wherein the at least one valve is a valve for switching between an aerator flow path and a flow path to the flow selector assembly for selecting one or more other sprayer functions.

46. The multifunction spray head for a faucet according to claim 45, further comprising a pause valve.

47. The multifunction spray head for a faucet according to claim 42, wherein each of the at least two flow selector valves has a valve head, a valve stem and a tensile member and wherein the valve head is capable of being depressed by the rotating selector valve ring or being expanded in a recess within the rotating selector valve ring.

48. The multifunction spray head for a faucet according to claim 42, wherein the face plate is configured to receive a brush head attachment.

49. The multifunction spray head for a faucet according to claim 42, wherein the outer selector ring has one or more tactile features for selecting a spray function.

50. The multifunction spray head for a faucet according to claim 42, wherein the jet sprayer function comprises a curved jet head and a divergent spray outlet recessed in the spray head.

51. The multifunction spray head for a faucet according to claim 42, wherein the flow body has an upper section and a lower section.

52. The multifunction spray head for a faucet according to claim 51, wherein flow body is interrupted by a valve for switching between an aerator flow path and a flow path to the flow selector assembly for selecting one or more other sprayer functions in its lower section and by a pause valve in its upper section.

* * * * *